US008186538B2

(12) United States Patent
MacCarthy

(10) Patent No.: US 8,186,538 B2
(45) Date of Patent: May 29, 2012

(54) FOOD-HOLDING RECEPTACLE FOR USE WITH A BEVERAGE CONTAINER

(76) Inventor: Patrick MacCarthy, Lakewood, CO (US)

( * ) Notice: Subject to any disclaimer, the term of this patent is extended or adjusted under 35 U.S.C. 154(b) by 855 days.

(21) Appl. No.: 11/279,366

(22) Filed: Apr. 11, 2006

(65) Prior Publication Data

US 2006/0261075 A1 Nov. 23, 2006

Related U.S. Application Data

(60) Provisional application No. 60/673,840, filed on Apr. 22, 2005.

(51) Int. Cl.

| | |
|---|---|
| ***A47G 19/00*** | (2006.01) |
| ***A47G 21/00*** | (2006.01) |
| ***A47G 23/00*** | (2006.01) |
| ***A47G 19/02*** | (2006.01) |
| ***B65D 25/00*** | (2006.01) |
| ***B65D 1/34*** | (2006.01) |
| ***B65D 6/04*** | (2006.01) |
| ***B65D 77/00*** | (2006.01) |

(52) U.S. Cl. ..... 220/737; 220/575; 220/574; 206/17; 206/217; 206/561; 206/562

(58) Field of Classification Search ..... 220/575, 220/737, 574; 206/17, 561, 562, 217
See application file for complete search history.

(56) References Cited

U.S. PATENT DOCUMENTS

| | | | | |
|---|---|---|---|---|
| 616,013 | A | 12/1898 | Robertson | |
| 2,920,804 | A | 1/1960 | Minton | |
| D211,532 | S | 6/1968 | Ashton | |
| 4,732,274 | A * | 3/1988 | Bouton | 206/561 |
| 4,938,373 | A | 7/1990 | McKee | |
| 5,058,737 | A | 10/1991 | Patterson et al. | |
| 5,060,820 | A | 10/1991 | Boerner | |
| 5,176,283 | A | 1/1993 | Patterson et al. | |

(Continued)

FOREIGN PATENT DOCUMENTS

| | | |
|---|---|---|
| DE | 29609115 | 8/1996 |

OTHER PUBLICATIONS

Official Office Action for U.S. Appl. No. 11/279,363, mailed Mar. 31, 2009, 22 pages.

(Continued)

*Primary Examiner* — Anthony Stashick
*Assistant Examiner* — Andrew T Kirsch
(74) *Attorney, Agent, or Firm* — Sheridan Ross P.C.

(57) ABSTRACT

An aid is provided for dining in situations where a food holding receptacle (such as a plate) and a beverage container must be simultaneously supported by a single hand. The food holding receptacle is stably mountable on an upright beverage container. The user holds a lower portion of the beverage container in one hand and uses the other hand to take food items from the receptacle that is supported on the beverage container. In order to drink from the beverage container the user removes the receptacle from the beverage container and drinks from the beverage container. The food holding receptacle is stably mounted on the beverage container in loose-fitting relationship so the receptacle can be repeatedly mounted on and demounted from the beverage container in a facile manner. The food holding receptacle may also be used to stably support a beverage container following inversion of the receptacle.

32 Claims, 15 Drawing Sheets

U.S. PATENT DOCUMENTS

| | | | | |
|---|---|---|---|---|
| 5,180,079 | A | 1/1993 | Jeng | |
| 5,207,743 | A * | 5/1993 | Costarella et al. | 220/574 |
| 5,234,125 | A | 8/1993 | Roberts | |
| 5,240,136 | A | 8/1993 | Patterson et al. | |
| 5,249,700 | A | 10/1993 | Dumke | |
| 5,259,528 | A | 11/1993 | Pace et al. | |
| 5,292,028 | A | 3/1994 | Patterson et al. | |
| 5,346,070 | A | 9/1994 | McSpadden | |
| 5,361,932 | A | 11/1994 | Friedrich | |
| 5,419,455 | A | 5/1995 | Russeau | |
| 5,421,459 | A | 6/1995 | Mazzotti | |
| 5,607,077 | A * | 3/1997 | Torkelson | 220/575 |
| 5,662,240 | A | 9/1997 | Norris | |
| 5,695,052 | A | 12/1997 | Damato | |
| 5,732,847 | A | 3/1998 | Caldi | |
| 5,915,561 | A | 6/1999 | Lorenzana et al. | |
| 5,954,195 | A | 9/1999 | Krueger et al. | |
| 5,984,131 | A | 11/1999 | Krueger et al. | |
| 6,021,914 | A | 2/2000 | Schmidt | |
| 6,138,860 | A | 10/2000 | Comeaux | |
| 6,338,417 | B1 | 1/2002 | Ferraro | |
| 6,360,885 | B1 | 3/2002 | Krueger et al. | |
| 6,425,480 | B1 | 7/2002 | Krueger et al. | |
| 6,427,864 | B1 | 8/2002 | Asselin | |
| 6,474,494 | B1 | 11/2002 | Miller | |
| 6,609,625 | B1 | 8/2003 | Gibbar | |
| 6,706,297 | B1 | 3/2004 | Toth et al. | |
| 6,824,002 | B1 | 11/2004 | Hadland | |
| D509,994 | S | 9/2005 | Hadland | |
| 7,726,512 | B2 | 6/2010 | MacCarthy | |
| 2004/0099670 | A1 | 5/2004 | Michaeli | |
| 2006/0255050 | A1 | 11/2006 | MacCarthy | |

OTHER PUBLICATIONS

Notice of Allowability for U.S. Appl. No. 11/279,363, mailed Mar. 15, 2010.

* cited by examiner

FOOD-HOLDING RECEPTACLE FOR USE WITH A BEVERAGE CONTAINER

CROSS-REFERENCE TO RELATED APPLICATIONS

This application claims priority to Provisional Patent Application Ser. No. 60/673,840, entitled FOOD-HOLDING RECEPTACLE FOR USE WITH A BEVERAGE CONTAINER, filed Apr. 22, 2005 and is incorporated herein by reference.

FIELD OF INVENTION

This invention relates to a food holding receptacle such as a plate, bowl, dish, tray or similar food holding item. More particularly it relates to a plate, bowl, dish, tray or the like that is of special value to a diner who wishes to support both the food holding receptacle and beverage container by a single hand. This leaves the user's second hand free for removing food items from the food holding receptacle or for other purposes. Still more specifically the present invention provides a food holding receptacle that is stably mountable on a beverage container that is held in a user's hand. The present invention is of value in many common situations such as parties, barbeques, picnics, and sporting events. The invention also has value in fast food restaurants, cafeterias, hospitals, and so on.

BACKGROUND OF THE INVENTION

Guests at cocktail parties often stand while eating. In such cases, they frequently hold a plate of food in one hand and a beverage container in the other hand. This creates a problem in trying to transfer food from the plate to one's mouth using the hand that is holding the beverage container. There is also difficulty in trying to support both the plate and beverage container by a single hand while using the other hand to transfer the food to one's mouth. Similar situations occur at parties, picnics, barbeques, sporting events, fast food restaurants, cafeterias and other venues where food and beverage are served. The difficulty of trying to support a food holding receptacle and a beverage container simultaneously either while eating or while carrying the food and beverage represents a long-standing problem and the problem continues to the present day.

This problem of trying to comfortably use a plate of food and a beverage container in a stand-up dining situation has been the subject of many patented inventions. There are two general approaches in the prior art to simultaneously supporting a food holding receptacle and a beverage container by a single hand. In the first general approach the beverage container is held in one hand and a plate or other food holding receptacle is supported on or by the beverage container. For example, U.S. Pat. No. 4,938,373 issued to McKee describes a plate that is supportable on a beverage container. The plate is similar to a regular plate, but the base of the plate has an upwardly protruding circular, hollow ridge. The cross section of the ridge resembles an inverted "V". Accordingly, the ridge has a hollow, upward facing, annular cavity on its undersurface. The upper part (rim) of a beverage container such as a glass or a paper cup is press fit into the annular cavity allowing the plate to be supported on the beverage container.

In another variation of this general approach (U.S. Pat. No. 5,695,052 issued to Damato) the base of the plate contains a radially scored section. The beverage container is forced downward through the scored region of the plate creating a cavity in the plate that encircles the beverage container. The plate is held on the beverage container by the force-fit between the two components. In this approach the beverage container, with the supported plate, is held in one of the user's hands, leaving the user's other hand free to remove items of food from the plate. There are several problems with this approach including the difficulty of repetitively removing the plate from, and replacing the plate on, the beverage container without spilling some of the beverage or tossing food items from the plate. The force necessary to remove the plate from the beverage container could cause food to be displaced from the plate when the plate disengages from the beverage container In another variation of this approach (U.S. Pat. No. 6,138,860 issued to Comeaux), a plate sits directly on top of a drinking glass. The underside of the plate has a non-slip surface to hinder the plate from sliding off the glass. In this case the user holds the beverage container in one hand, while the plate is supported by the beverage container. This invention suffers from several disadvantages. For example, if another person bumped into the diner, the plate could be easily knocked off the beverage container. Also, such a design would be even less satisfactory for use with certain beverage containers such as bottles.

In still another variation of this approach, exemplified by U.S. Pat. Nos. 5,954,195; 5,984,131 and 6,360,885 all issued to Krueger and Perez; and U.S. Pat. No. 6,425,480 issued to Krueger, Perez and Jansson the base of the food holding receptacle contains an upwardly protruding hollow hub that is attached to the base of the plate. The plate is mounted on a beverage container by pressing the plate onto a top portion of the beverage container. The upper portion of the beverage container enters the hub from below the plate and through a hole in the base of the plate until the hub engages with the beverage container. The user holds the beverage container in one hand with the plate supported by the beverage container. In U.S. Pat. No. 5,954,195 several embodiments of such a plate are described, each with a differently shaped hub to snugly fit part of the outer surface of different beverage containers. The inner surface of the hub is designed to be exactly complementary in shape and dimensions to the outer surface of the upper portion of the beverage container. This maximizes the contact area between the inner surface of the hub and the upper surface of the beverage container and provides a snug-fitting or tight-fitting connection between the receptacle and beverage container that requires the receptacle to be pressed onto the upper portion of the beverage container. One of the embodiments shown has a hub with an interior section that matches exactly the outer surface of a conventional beverage can; that embodiment is designed to be pressed onto a conventional beverage can. Another embodiment shown in U.S. Pat. No. 5,954,195 is designed to be supported on a particular shaped bottle where the inner surface of the hub exactly matches a portion of the outer surface of the bottle; the food holding receptacle is pressed onto the bottle. U.S. Pat. No. 5,984,131 describes a food holding receptacle in the form of a plate-lid that snaps onto the upper ridge or rim of a beverage container to form a seal between the receptacle and the beverage container. U.S. Pat. No. 6,360,885 describes a food holding receptacle in the form of a plate-lid that is snap-fit onto a cup having a lip at its upper end. U.S. Pat. No. 6,425,480 discloses food holding receptacles in the form of plate-lids each requiring a differently shaped hub for use with bottles of different diameters. In the U.S. Pat. No. 6,425,480 the plate lid connects with the neck of the bottle by an engagement means such as a screw-on or snap-on connection. In each of the Krueger et al. patents described above some degree of force or twisting must be used in order to properly mount the food holding receptacle on the beverage container. However, a press-fit or snap-on engagement is awkward for mounting a food holding receptacle on a beverage container in a dining situation. Disengaging a receptacle from a beverage container where a press-fit or snap-on engagement is involved could also be awkward. A screw-on engagement mechanism between the food holding receptacle and beverage container adds an extra operation to both mounting the receptacle on, and demounting the receptacle from, the beverage container. This is undesirable particularly when the receptacle must be repetitively mounted on and demounted from the beverage container in a dining situation.

U.S. Pat. No. 5,060,820 issued to Boerner has a downwardly extending member or members on the underside of the base of a plate. This member extends essentially perpendicular to the base of the plate and lies alongside the outer wall of a beverage container positioned immediately under the plate and upon which the plate is seated. The user simultaneous grasps the extending member and the beverage container by a single hand and thereby supports both the plate and the beverage container. In an alternative embodiment of the Boerner invention the downwardly extending member is in the form of a cylindrical arc that extends around more than half the circumference of a cup with a handle, thereby directly supporting the plate; in this case the user does not grasp the extending member but holds the cup by its handle, with the plate supported on the cup.

U.S. Pat. No. 5,662,240 issued to Norris comprises a plate having handles in the form of loop-shaped members extending downwardly from the underside of the plate. The plate is placed on top of a beverage container that is held in a user's hand, and the plate is gripped by the user placing a finger and a thumb from the hand that is holding the beverage container through the loops.

Other approaches to mounting a plate or similar receptacle on a beverage container are disclosed in U.S. Pat. Nos. 5,058,737; 5,176,283; 5,240,136; and 5,292,028 all issued to Patterson and Patterson; U.S. Pat. No. 5,180,079 issued to Jeng; U.S. Pat. No. 5,732,847 issued to Caldi; and U.S. Pat. No. 6,427,864 issued to Asselin.

The second general approach to simultaneously supporting a food holding receptacle and a beverage container by a single hand involves holding the receptacle in one hand with the beverage container supported on or by the receptacle. For example, U.S. Pat. No. 5,207,743 issued to Costarella and Shohara describes a plate containing a downwardly extending hollow tubular section. The beverage container is mounted on the plate by inserting the beverage container into the hollow section. The beverage container rests on the side walls of the hollow section. The user holds the outer wall of the tubular section in one hand with the beverage container supported on the plate.

In another variation of this approach (U.S. Pat. No. 5,249,700 issued to Dumke) the base of the plate contains a hole in the center surrounded by an upwardly-protruding frusto-conical lip. The beverage container is inserted in the hole from above the plate and rests on the perimeter of the hole. The plate, with the beverage container supported thereon, is held in one of the user's hands, leaving the user's other hand free to remove items of food from the plate.

In still another variation of this approach exemplified by U.S. Pat. No. 5,346,070 issued to McSpadden the base of a tray has a section containing a substantially cup-like depression. The beverage container is mounted on the plate by placing the bottom portion of the container into the cup-like depression from above. The beverage container rests inside the cup-like depression. The bottom of the cup-like depression may be removable to facilitate taller (frusto-conical) cups, in which case the container protrudes from the underside of the tray. The user holds the outer wall of the cup-like depression in one hand while the plate is resting on part of that hand and wrist. This leaves the user's other hand free to pick food items from the tray or for other activities.

Other approaches to supporting a beverage container on or by a plate or similar receptacle are disclosed in U.S. Pat. No. 5,234,125 issued to Roberts; U.S. Pat. No. 5,259,528 issued to Pace and Girovich; U.S. Pat. No. 5,361,932 issued to Friedrich; U.S. Pat. No. 5,421,459 issued to Mazzotti; and U.S. Pat. No. D211,532 issued to Ashton. The plate disclosed by McKee in U.S. Pat. No. 4,938,373 (described above) is also capable of supporting a beverage container.

In addition to the prior art found in patents, there have been and are several items on the market for addressing the problem of supporting a plate and a beverage container simultaneously while dining. In particular, plates variously referred to as party plates, cocktail plates or buffet plates are available for holding stemware. Some of these commercial products are occasionally seen at buffet functions and can be found in specialty stores.

The problem of trying to support both a food holding receptacle and a beverage container simultaneously is not limited to the immediate period during which the food and beverage are being consumed. For example, it can be awkward trying to make one's way through a throng of people in a stadium or other packed event while carrying a food holding receptacle and a beverage container simultaneously. The present invention alleviates that problem.

Definitions of Terms

The following terms are defined as used in the specification and claims of this patent. Other terms are defined or explained at their point of usage in the specification.

Food holding receptacle: This is a container for holding food in a dining situation such as a plate, a bowl, a dish, or a tray; the food holding receptacle can also be used when carrying food and/or beverage.

Plate: A plate for holding food, one of various food holding receptacles. The plate (or other food holding receptacle) of the present invention has at least one food holding orientation and may have two food holding orientations.

When a food holding receptacle has only one operative food holding orientation it will be referred to herein as the first specified food holding orientation. When a food holding receptacle has two operative food holding orientations, one food holding orientation will be referred to herein as the first specified food holding orientation which is the more conventional orientation of the plate when dining, and the second is referred to herein as the second specified food holding orientation.

The plate of the present invention contains a base, that is, a bottom section that is usually, but not necessarily, flat.

The base has a first surface that can function as a first food holding section and has a second surface on the face opposite the first surface that in some embodiments may function as a second food holding section. If the plate of the present invention were to be placed in its first specified food holding orientation on a table, the first surface would face upward, and would be suitable for holding food items. The second surface would face downward and would be in contact with or close to the surface of the table.

There are three possible modes for using the food holding receptacle of the present invention. The receptacle of the present invention is designed primarily for being directly supported on a beverage container where the beverage container is held in one of the user's hands (mode 1). Some embodiments may additionally be used in mode 2. In mode 2 of using the receptacle of the present invention a beverage container is supported on the receptacle while the receptacle is held in one of the user's hands. In mode 3 the receptacle is supported on a connector unit which in turn is supported on a beverage container that is held in one of the user's hands. In mode 1 the food holding receptacle of the present invention, in its first specified beverage holding orientation, is stably mounted on a beverage container and the user grasps the beverage container by a single hand. The receptacle is mountable on the beverage container in a loose-fitting relationship and the mounting and demounting of the receptacle relative to the beverage container are both facile operations. The beverage container acts as a handle for gripping and for supporting the food holding receptacle. In mode 2, a beverage container is stably supported on the food holding receptacle while the receptacle is in its second specified food holding orientation, and the food holding receptacle is held by a single hand. In mode 3, the food holding receptacle in its first specified food holding orientation is stably mounted on a beverage container through a connector unit. In some cases, a lower portion of the connector unit snaps, or otherwise firmly connects, onto the upper portion of the beverage container in a sealed or leak-proof manner. The upper portion of the connector unit is insertable into the underside of the receptacle in its first specified food holding orientation and the receptacle is thereby mountable on the connector unit. Alternatively, the food holding receptacle may be mounted on the connector unit in tight-fitting relationship, and the lower section of the connector unit may be mounted on the beverage container in loose-fitting relationship. The user grasps the beverage container by a single hand as in mode 1 and thereby supports the food holding receptacle.

The plate contains a rim, that is, an upwardly positioned segment or wall near the outer edge of the plate when the plate is oriented in one of its specified food holding orientations; the rim prevents food from falling over the edge of the base. Throughout this disclosure it is assumed that the plate (or other food holding receptacle) is positioned with its base generally horizontal when in use, as with a conventional plate. The base could be curved with a wok-type shape where the first food holding surface is concave; in this case, there may be no need for the plate to have a distinct rim.

The food holding receptacle of the present invention has a hole or opening that penetrates the base of the receptacle—the hole extends completely through the base. The hole may have one of several shapes including circular, polygonal and other shapes.

In embodiments of the food holding receptacle of the present invention a collar protrudes upwardly from the hole when the receptacle is in its first specified food holding orientation. This collar is hollow and has an inner surface with a non-uniform cross section; the cross section has a greater internal diameter in the vicinity of the hole than in a region further upward from the hole. In other words, the collar has a constriction upward from the hole in the base when the receptacle is in its first specified food holding orientation. This constriction allows beverage containers to be partially, but not completely, inserted into the collar from the underside of the receptacle (in its first specified food holding orientation). As a result, the food holding receptacle can rest on, and be supported by, the beverage container. The collar serves as a mounting means that renders the receptacle stably mountable on a beverage container in a loose-fitting relationship. In mode 3, the connector unit is partially insertable into the collar from the underside of the receptacle and the receptacle is mountable on the connector unit.

In mode 2 of using the food holding receptacle of the present invention, the plate (or other food holding receptacle) is positioned in its second specified food holding orientation. The second specified food holding orientation is produced by rotating the plate essentially 180° relative to the first specified food holding orientation about a horizontal axis. In the second specified food holding orientation the collar extends below, or largely below, the level of the base. The lower part of a beverage container (in its specified beverage holding orientation) can be inserted into the chamber of the collar from above and the constriction in the collar, or the hole perimeter, prevents the beverage container from falling through the collar. The user grasps the collar by a single hand thereby supporting the receptacle while the beverage container is sitting in the chamber of the collar.

The term beverage container refers to any drinking vessel such as a bottle, a can, a stemware glass, a non-stemware glass, a cup, a mug, and so on. While the term beverage container is used throughout this disclosure it is clear that certain beverage containers, such as some glasses and frusto-conical cups, could also be used to hold other food items such as a milkshake, or solid items such as French fries, a salad, a dessert, and so on. Accordingly it is understood that the beverage container in the present disclosure could be used to hold other food items, particularly in mode 2 of using the food holding receptacle. The term specified beverage holding orientation applies to the beverage container in its upright position, referring to the normal orientation of an open beverage container when it is used for holding a beverage while dining (even though the food holding receptacle of the present invention may also be used in conjunction with unopened or closed beverage containers).

The terms loose-fitting and loosely are used interchangeably in describing the association of the food holding receptacle of the present invention with a beverage container. These terms refer to the facts that:

(i) the food holding receptacle of the present invention can be stably mounted on a beverage container by positioning the receptacle over a beverage container and gently lowering the receptacle onto the beverage container without having to press the receptacle onto the beverage container;

(ii) the properly mounted food holding receptacle can be readily removed from the beverage container without the user having to exert any force other that necessary to overcome the force of gravity; and;

(iii) the receptacle, when stably mounted on the beverage container, is generally rotatable relative to the beverage container about a vertical axis.

For some embodiments of the present invention the terms loose fitting relationship and loosely refer to the relationship between the inner surface of the collar and part of the outer surface of the beverage container. The inner surface of the collar is disposed to partially surround and rest on an upper portion of a beverage container in a loose-fitting relationship. This means that the collar of the receptacle can fit over an upper portion of a beverage container in a facile manner without the user having to press or otherwise force the receptacle onto the container; the receptacle slips onto the beverage container until part of the container encounters a restriction upon which the food holding receptacle can comfortably and stably rest. When the receptacle is mounted on the beverage container part of the beverage container lies within the chamber of the collar. Because of the loose-fitting relationship, the receptacle and beverage container can also be separated from each other in a facile manner without the user having to exert any particular force during the separation, other than perhaps having to overcome the force of gravity. The loose-fitting relationship between the food holding receptacle of the present invention and the beverage container can be illustrated as follows. The beverage container in its specified beverage holding orientation is placed on a table and is not gripped by the user's hand. The food holding receptacle is then mounted on the beverage container in its intended manner of use, simply by allowing the receptacle to slip onto the beverage container. The food holding receptacle is then raised vertically upward. Because of the loose-fitting relationship, the beverage container remains sitting on the table. Separation of the receptacle from the beverage container in the present invention is accomplished through a simple translational motion without the user having to rotate the beverage container relative to the receptacle. Another indication of the loose-fitting relationship between the food holding receptacle of the present invention and a beverage container is that generally the receptacle can be readily rotated (spun) about a vertical axis relative to the beverage container while the receptacle is stably mounted on the beverage container in its specified beverage holding orientation. Because of the loose-fitting relationship between the food holding receptacle of the present invention and a beverage container, the receptacle will fall off the beverage container if the beverage container that is supporting the receptacle is inverted from its specified beverage holding orientation.

In preferred embodiments of the present invention the food holding receptacle rests or sits on a beverage container due to the weight of the receptacle and any food items thereon, with part of the beverage container surrounded by the collar of the receptacle. There is no actual engagement between the receptacle and the beverage container meaning that the receptacle and container are not held together by a press-fit, snap-on, screw-on, twist-on, tongue-in-groove or other such type of specific connection. (In some embodiments of the invention using a connector unit, the lower end of the connector unit is engaged with an upper portion of the beverage container in a leak-proof manner). Despite the loose-fitting relationship between the inner surface of the collar and an outer portion of a beverage container as discussed above, the receptacle is stably mountable on the beverage container as discussed in the next two paragraphs.

In the specification and claims of this disclosure the terms stable and stably refer to mounting of the food holding receptacle on a beverage container, when the receptacle is in its first specified food holding orientation (modes 1 and 3); these terms also refer to supporting a beverage container when the food holding receptacle is in its second specified food holding orientation (mode 2). The terms stable and stably in the context of mode 1, mean that the food holding receptacle, in its first specified food holding orientation, is mounted on the beverage container in such a manner that the receptacle does not easily fall off or slide off the beverage container when in use and that the receptacle is not easily knocked off the beverage container even when the user is given a jolt. The previous comment also applies to mode 3, where a connector unit is used to attach the food holding receptacle to the beverage container. Typically, the food holding receptacle in several embodiments of the present invention would not fall off the beverage container even when the beverage container is tilted as much as 70° to 80° from its specified beverage holding orientation (modes 1 and 3). The stable mounting of the food holding receptacle of the present invention on a beverage container can be further illustrated as follows. A beverage container is held in its specified beverage holding orientation and the receptacle is stably mounted on the beverage container. When the beverage container is then oscillated in a horizontal line at a frequency up to 180 Hz and at an amplitude of about 9 inches for a period of about one minute, the receptacle remains stably mounted on the beverage container. Despite this stable mounting of the food holding receptacle on the beverage container the receptacle is readily removed from the beverage container (mode 1) or from the connector unit that is mounted on the beverage container (mode 3, when receptacle is mounted on the connector unit in a loose-fitting relationship) simply by lifting the receptacle upwards while maintaining the beverage container stationary, or by moving the beverage container downward while holding the receptacle stationary, or by moving the receptacle upward while moving the beverage container downward. This disposition for facile separation of the receptacle from the beverage container, in some embodiments of the present invention, results from the loose-fitting relationship between the receptacle and the outer surface of the beverage container. The receptacle of the present invention does not have to be pressed onto the beverage container (mode 1) or onto the connector unit (mode 2), and the user does not have to apply any additional force to separate the receptacle from the beverage container other than to overcome the force of gravity in some cases.

When the receptacle of the present invention is stably and loosely mounted on a beverage container the receptacle is generally suspended from an upper portion of the beverage container. The section of the inner surface of the collar, or of the perimeter, that rests on the beverage container is referred to as the suspension region of the receptacle.

The terms stable and stably in the context of the second specified food holding orientation (mode 2) of the food holding receptacle mean that the beverage container is supportable on the receptacle in such a manner that the beverage container does not easily fall off the receptacle and is not easily knocked off the food holding receptacle even when the user is given a jolt. Typically, the beverage container in several embodiments of the present invention would not fall off the food holding receptacle even when the receptacle is tilted as much as 70° to 80° from its second specified food holding orientation. The food holding receptacle in its second specified food holding orientation (mode 2) is particularly well suited for stably supporting frusto-conical cups, common beverage cans, and other beverage containers. Despite this stable supporting of the beverage container on the food holding receptacle, the beverage container is readily removed from the receptacle simply by lifting the beverage container upwards while maintaining the food holding receptacle stationary, or by moving the receptacle downward while holding the beverage container stationary, or by moving the beverage container upward while moving the receptacle downward.

The term freely supported or freely mounted is used in association with supporting or mounting the receptacle of the present invention on a beverage container. A freely supported or freely mounted food holding receptacle means that the receptacle is supported or mounted on a beverage container: (i) in the absence of any form of active engagement between the receptacle and container (such as a press-fit, snap-on, screw-on, twist-on, tongue-in-groove or other such type of specific connection), and (ii) without the user having to grip any part of the receptacle or any appendage depending from the receptacle in order to maintain the receptacle firmly mounted on the beverage container. Inversion of a beverage container having a receptacle mounted thereon according to its prescribed method of use causes the receptacle to fall off the beverage container if the receptacle is freely supported on the beverage container.

The term upper portion, used in relation to a beverage container, refers to any portion of a beverage container generally above a section used to grip the beverage container by one's hand when the receptacle is mounted on the beverage container. Thus, while the term upper portion of a beverage container could include the top of the beverage container the term is not limited to the top; for example, the receptacle of the present invention may rest on an upper portion of a long-neck bottle where upper portion refers to the shoulder of the bottle; in this case, the top of the bottle may protrude above the level of the collar. The portion of the bottle extending below the receptacle is gripped by the user (mode 1 and mode 3). In the case of a mug having a handle, the upper portion lies above the level of the handle.

The term frusto-conical is used to describe some beverage containers such as the classic SOLO® cups and common disposable coffee cups that have the general shape of a frustum, that is a truncated cone.

SUMMARY OF THE INVENTION

There is need for an effective means of simultaneously supporting both a food holding receptacle and a beverage container by a single hand while dining, leaving the user's second hand free to remove food items from the food holding receptacle or for other purposes. The present invention provides an aid for dining in stand-up situations (and other situations where the diner does not have the benefit of a table such as in a movie theatre, traveling on a bus, or while walking) and is an improvement on devices described in the above-cited patents.

A preferred embodiment of the food holding receptacle of the present invention has a base with a hole therethrough. Protruding from this hole is a collar that extends upwardly when the receptacle is in its first specified food holding orientation. The collar is composed of a hollow tubular segment and looks like a chimney protruding upwardly from the base of the receptacle. The collar encloses a chamber into which a beverage container can be partially inserted. The food holding receptacle in its first specified food holding orientation can be mounted on a beverage container in its specified beverage holding orientation whereby the collar surrounds part of the beverage container. The collar of the receptacle is constructed so that the beverage container can penetrate the collar only partially before encountering a constriction (or other restriction) that prevents further entry of the beverage container. The term restricting means will be used to describe any form of restriction or constriction that prevents the complete passage of a beverage container through the hole in the base. The perimeter of the hole itself may serve as the restricting means for some beverage containers. This constriction or obstruction allows the receptacle to be supported on the beverage container. A sufficient portion of the beverage container protrudes from underside the food holding receptacle, when the receptacle is mounted thereon, to allow a person to firmly grip the beverage container. A person grips the beverage container at a point underneath the receptacle and thereby supports the beverage container and receptacle by means of a single hand. This leaves the other hand free to manipulate food on the receptacle.

The food holding receptacle of the present invention can be used as follows when the receptacle is in its first specified food holding orientation (mode 1). A person places food on the first surface of the receptacle which serves as the first food holding section. The receptacle is then stably mounted on a beverage container in a loose-fitting relationship where the beverage container is in its specified beverage holding orientation as described above and held in a user's hand. Alternatively, a person may first mount the food holding receptacle on the beverage container and then place the food items on the receptacle. The user can now hold the beverage container with the food holding receptacle supported thereon, by a single hand in a convenient and stable manner. The user can conveniently and comfortably pass food from the receptacle to his or her mouth using the hand that is not gripping the beverage container. When a person wishes to drink some of the beverage, it is a simple matter to grip the food holding receptacle in the conventional manner by the free hand, remove the beverage container from beneath the receptacle, and drink from the beverage container in the conventional manner. In some cases, the user may wish to use a straw in order to drink from the beverage container while the food holding receptacle is mounted thereon, and where the straw is inserted through the top of the collar and into the beverage container. In this case there is no need to remove the food holding receptacle from the beverage container while one is dining. Straws that are somewhat longer than conventional straws, or straws that are of special shapes or bendable into special shapes, are useful in this context.

Going through a food line with the food holding receptacle of the present invention mounted on a beverage container is more convenient than when holding a conventional plate at its rim. In the case of the present invention, the beverage container serves as a centrally located handle for stably supporting the food holding receptacle in a symmetrical and balanced manner.

In directly mounting the food holding receptacle of the present invention on a stationary beverage container (mode 1) the receptacle is simply allowed to slip onto the beverage container whereby the beverage container enters the collar without any significant resistance (until the beverage container encounters the restricting means). The receptacle is then allowed to simply rest or sit on part of the beverage container. Similarly when the beverage container is moved upward into a stationary collar no significant resisting force other than that due to the weight of the beverage container is encountered (until the beverage container encounters the restricting means). This lack of a resisting force is due to the loose-fitting relationship between the inner surface of the collar of the food holding receptacle and the outer surface of the beverage container. This loose-fitting relationship is desirable because the receptacle must be mounted on and demounted from the beverage container in a dining situation. The mounting and demounting operations must be performed repetitively while dining. If the relationship between the inner surface of the collar and the outer surface of the beverage container were snug-fitting or tight-fitting, the receptacle would have to be pressed or forced onto the beverage container. This would be awkward in a dining situation, particularly when gripping the receptacle at its outer edge, and could lead to food items being thrown from the plate or spillage of beverage. Also, removing the mounted receptacle from the beverage container in such a case (i.e. where there is a snug fit between the receptacle and beverage container) would require an extra force; this would be awkward (again, particularly when gripping the receptacle at its outer edge) and could lead to spillage of beverage and tossing of food from the receptacle when the receptacle disengages from the beverage container. The receptacle of the present invention is stably mountable on the beverage container despite the loose-fitting relationship between the two components. Even though the food holding receptacle of the present invention is mountable on a beverage container in a loose-fitting relationship, the food holding receptacle is, nevertheless, stably mountable on the beverage container in this loose fitting relationship.

When the food holding receptacle of the present invention is a plate, some embodiments of the receptacle can also be used in a second specified food holding orientation wherein the collar extends downward (rather than upward as in the first specified food holding orientation) from the first surface of the base which is now facing downward. This method of using the receptacle is referred to as mode 2. The second specified food holding orientation is obtained by rotating the receptacle essentially 180° with respect to the first specified food holding orientation, about a horizontal axis. In this case, the bottom part of the beverage container in its specified beverage holding orientation is inserted into the chamber of the collar from above the receptacle. The constriction in the collar, or the perimeter of the hole in the base, prevents the beverage container from passing completely through the collar. The beverage container is supported by the collar (or by the perimeter of the hole) of the food holding receptacle and the user holds the receptacle by grasping the outer surface of the collar. In this case, food items are placed on the second surface of the receptacle that functions as the second food holding section of the receptacle. Mode 2 works particularly well with frusto-conical cups such as the paper and plastic disposable cups commonly used for holding coffee, water, soda and beer. In this mode, frusto-conical cups of different dimensions can be accommodated by a receptacle of particular dimensions. Many frusto-conical cups have a relatively wide mouth and are found in a wide range of diameters. In order to use these cups in association with the receptacle of the present invention in its (first) specified food holding orientation a connector unit may be useful. In such cases the connector unit may be snapped onto, screwed onto, or otherwise attached to, the upper portion of the beverage container in its specified beverage holding orientation. This connector unit is designed so the collar of the food holding receptacle of the present invention is comfortably and stably mountable on an upper portion of the connector unit that is attached to the beverage container. This method of using the receptacles is referred to as mode 3. For example, the connector unit may consist of a special lid for a frusto-conical cup where the lid, with an opening therein, attaches to the cup in a conventional manner; the upper section of the lid is designed so that it fits into the collar from below the food holding receptacle when the food holding receptacle is positioned in its first specified food holding orientation. Thus, the food holding receptacle is stably mountable on the beverage container via the connector unit. Similarly, a connector unit may be used in mounting the receptacle on other types of beverage container such as bottles, cans, etc. The user may drink from the opening in the connector unit that is attached to the beverage container; the sealed connection between the connector unit and the beverage container prevents spillage of the beverage. For some beverages the user may prefer to use a straw that passes through the connector unit and into the beverage container. Again, a straw that is longer than conventional straws is of value in this context.

OBJECTS AND ADVANTAGES OF THE INVENTION

An object of the present invention is to provide a food holding receptacle that facilitates supporting both the receptacle and a beverage container by a single hand simultaneously while dining or carrying the receptacle and beverage container.

Another object of the present invention is to provide a food holding receptacle that is stably mountable on a beverage container so that the user can comfortably support both the food holding receptacle and a beverage container by a single hand in stand-up dining situations such as cocktail parties, picnics and other venues.

Another object of the present invention is to provide an arrangement whereby a food holding receptacle can be repetitively stably mounted on and demounted from a beverage container in a facile manner where the beverage container is held in a user's hand, and where the arrangement prevents beverage from being spilled and food from being tossed off the receptacle during such mounting and demounting.

Another object of the present invention is to provide a food holding receptacle that is stably mountable on a beverage container and where the stably mounted beverage container is readily rotated relative to the beverage container about the axis of the container.

Another object of the present invention is to provide a food holding receptacle that is stably mountable on a beverage container in a loose-fitting relationship and that is readily mountable on and demountable from the beverage container where the mounting and demounting actions encounter essentially no force other than that due to gravity.

Another object of the present invention is to provide a food holding receptacle having a non-cylindrical collar that is stably mountable on an upper portion of a beverage container.

Another object of the present invention is to provide a food holding receptacle having a collar that is stably mountable on an upper portion of a beverage container in a loose-fitting relationship, and where the receptacle can be rotated essentially 180° about a horizontal axis to provide an alternative orientation where the receptacle can stably support a beverage container in addition to holding food.

Another object of the present invention is to provide a food holding receptacle that is mountable on a connector unit which in turn is attachable to the upper portion of a beverage container thereby allowing the food holding receptacle to be stably supported by the beverage container.

Another object of the present invention is to provide an arrangement comprising a food holding receptacle, a connector unit, and a beverage container wherein the receptacle is mountable on the connector unit and the connector unit, in turn, is connectable to an upper portion of the beverage container.

Another object of the present invention is to provide a food holding receptacle that is stably mountable on a beverage container in the absence of any gripping means depending from the underside of the receptacle.

Another object of the present invention is to provide a food holding receptacle as described in any of the objects stated above where the receptacle is stackable on another identical receptacle.

REFERENCE NUMERALS IN DRAWINGS

Figure 1:
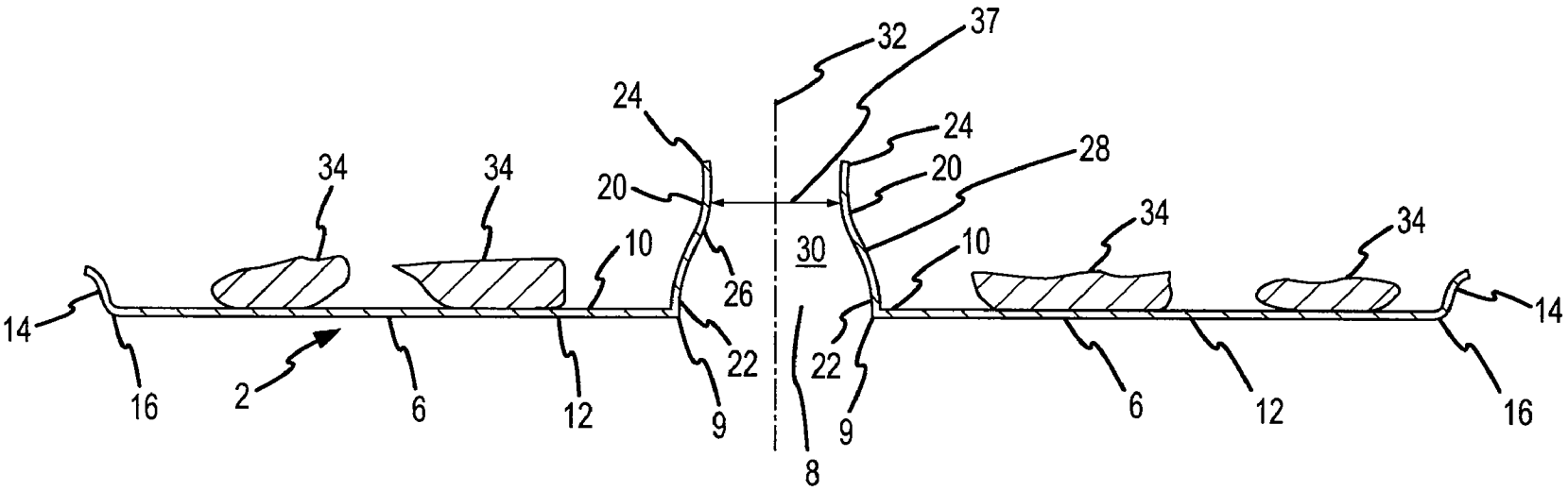
FIG. 1 shows a side view of an embodiment of the food holding receptacle of the present invention in the orientation as used in mode 1.

The food holding receptacle of the present invention is illustrated as a plate or as a bowl in the drawings.

2. Plate (one of several forms of the food holding receptacle of the present invention; other specific embodiments of the plate of the present invention are designated as 41, 42, and 43 as indicated below)

4. Bowl
6. Base
8. Hole in base of food holding receptacle
9. Perimeter of hole 8
10. First surface of base 6
12. Second surface of base 6
14. Rim
16. Outer edge of base 6
20. Collar
22. First end of collar (adjacent base 6)
24. Second end of collar
26. Inner surface of collar
28. Outer surface of collar
30. Chamber of collar
32. Imaginary axis
34. Food items
36. Bottle
37. Constriction in collar
38. Upper portion of beverage container
39. Cylindrical collar with fins
40. Fin
41. Embodiment of food holding receptacle for mounting on a can
42. Embodiment of food holding receptacle for mounting on a stemware glass
43. An embodiment of the food holding receptacle for use in both mode 1 and mode 2
44. Bottom portion of beverage container
47. Can
48. Stemware glass
50. Frusto-conical bowl
52. Frusto-conical cup
53. Barrier on receptacle
54. First segment of barrier 53
55. Suspension region (of receptacle)
56. Second segment of barrier 53
58. Apex of barrier 53
59. Another embodiment of rim
60. First segment of rim 59
62. Second segment of rim 59
64. Apex of rim 59
65. Popcorn
66. Connector unit
70. Upper section of connector unit
72. Lower section of connector unit
74. Aperture in an otherwise closed end of connector unit 66
75. Another embodiment of connector unit
76. Collar insert
78. Another embodiment of food holding receptacle

DETAILED DESCRIPTION

The food holding receptacle of the present invention is described and illustrated primarily in terms of a plate 2 in this disclosure even though the invention may take other forms such as a bowl 4, bucket, dish, tray, or other item intended for holding food by a diner. All embodiments of the food holding receptacle of the present invention may be used in two different modes. Some embodiments may also be used in a third mode.

Figure 2:
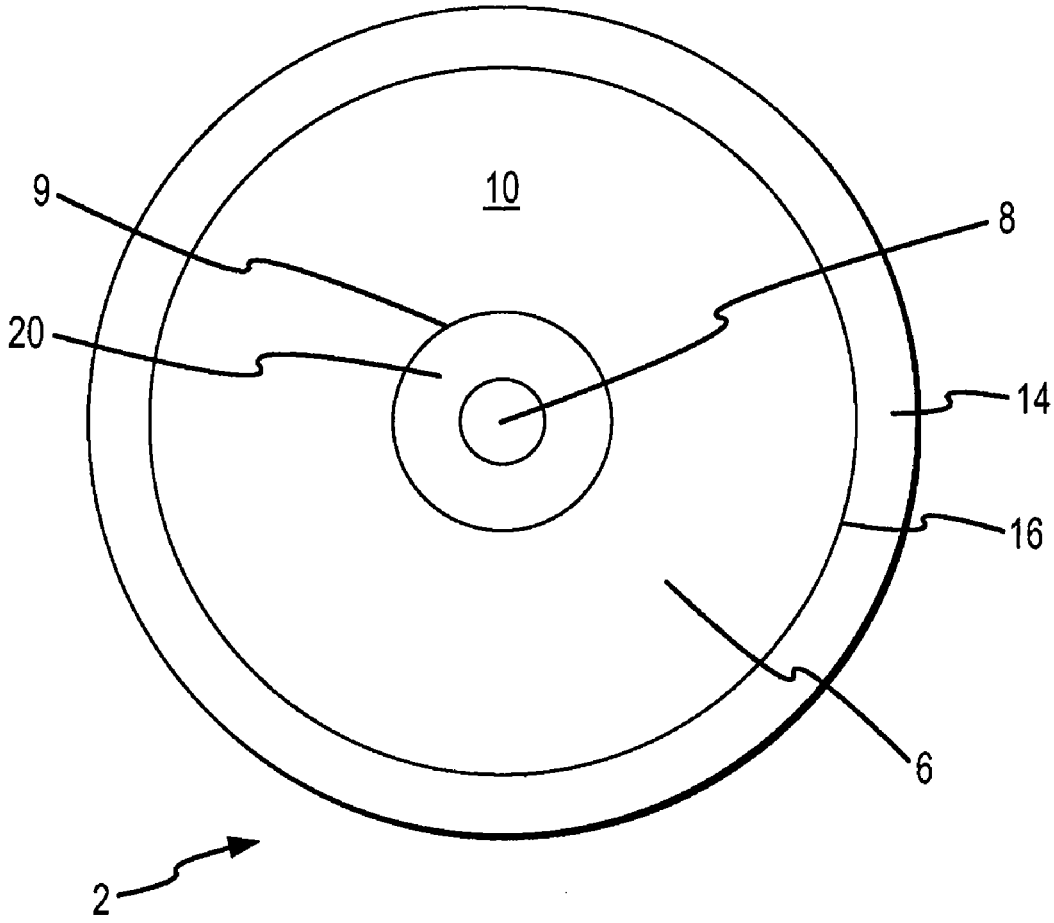
FIG. 2 shows a top view of the embodiment shown in FIG. 1.

FIG. 1 shows a side view of one embodiment of the present invention with the food holding receptacle in the orientation as used in mode 1, that is, the receptacle is in its first specified food holding orientation. Plate 2 (and other food holding receptacles of this invention) has a base 6. A hole 8 penetrates base 6 of plate 2 (or other food holding receptacle) producing an inner edge in base 6; this inner edge constitutes the perimeter 9 of hole 8. Adjacent hole 8 is a first surface 10, and on the opposite side of surface 10 is a second surface 12. When plate 2 is in its first specified food holding orientation first surface 10 is upward facing, and second surface 12 is downward facing as shown in FIG. 1. Plate 2 has a rim 14 at its outer edge 16; rim 14 is oriented upwardly as shown in FIG. 1. If plate 2 is placed on a table or other flat support in its first specified food holding orientation (i.e. with first surface 10 facing upward) then at least part of downward facing surface 12 comes into contact with the upper surface of the table or other flat support. Plate 2 may be circular as illustrated in FIG. 2. Other plate shapes are also possible with this invention, such as oval, triangular, rectangular, square, polygonal, dumbbell, and so on.

In the embodiment shown in FIGS. 1 and 2, hole 8 is centrally and symmetrically located in circular plate 2. In other embodiments, hole 8 may be located off-center. When base 6 and hole 8 are circular and arranged as shown in FIG. 2, base 6 is annular in shape. Protruding upwardly from base 6, in the first specified food holding orientation as shown in FIGS. 1 and 2, is a collar 20. Collar 20 consists of a hollow tubular segment having a first end 22, a second end 24, an inner surface 26, an outer surface 28, and a chamber 30. In the embodiment shown in FIG. 1, first end 22 of collar 20 is congruent with and attached to perimeter 9 of hole 8. Alternatively, first end 22 of collar 20 may have a diameter that is larger than that of perimeter 9; in such a case first end 22 is not coincident with perimeter 9 but closely surrounds the perimeter while attached to base 6. Second end 24 of collar 20 is distal to first end 22. The dotted line in FIG. 1 shows an imaginary axis 32 perpendicular to base 6 of plate 2 and passing centrally through hole 8 that is centrally located in base 6 of plate 2. Rotation of the line drawing of plate 2 in FIG. 1 about axis 32 generates the complete plate as shown from the top view in FIG. 2 (in the case of this centrosymmetric embodiment). First surface 10 (upward facing in FIGS. 1 and 2) of base 6 constitutes the first food holding section of plate 2, and food items 34 are placed on this first food holding section (first surface 10). Food items 34 may consist of solid items and may also contain fluid items such as gravy or sauce. Rim 14 prevents food items 34 from falling off the outer edge of plate 2, and collar 20 prevents food items 34 from falling into hole 8 in base 6 of plate 2.

Figure 3A:
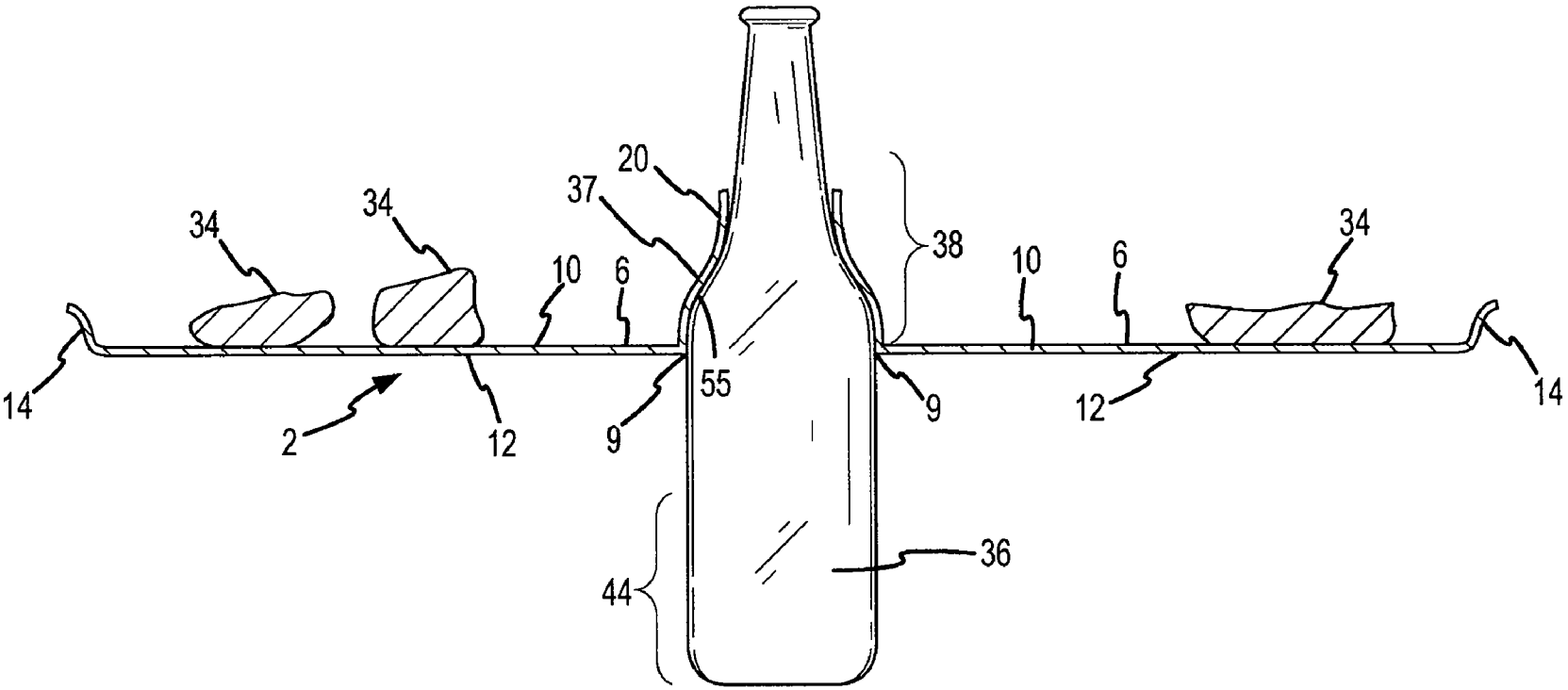
FIG. 3A shows a side view of the embodiment of the food holding receptacle from FIG. 1 mounted on a bottle (mode 1).
Figure 4:
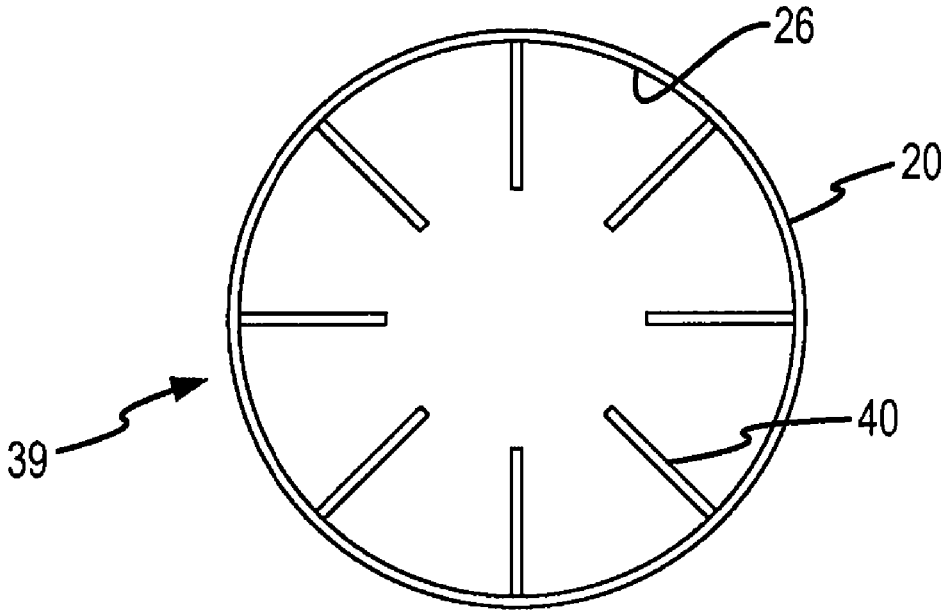
FIG. 4 shows a top view of an embodiment of the collar having fins extending from inner surface of collar.
Figure 5:
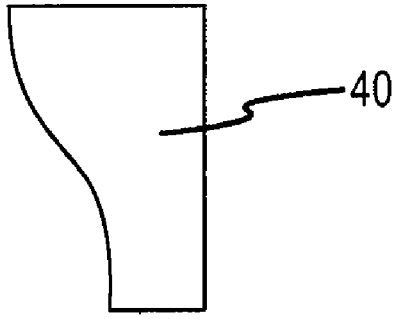
FIG. 5 shows a side view of one of the fins in FIG. 4.

Plate 2 is intended for use in association with a beverage container such that by holding plate 2 in its first specified food holding orientation, collar 20 can be placed over and around upper portion 38 of a beverage container that is positioned in its specified beverage holding orientation, and where the plate is mounted on the beverage container in a loose-fitting relationship. This is shown in FIG. 3A where the food holding receptacle from FIG. 1 is mounted on bottle 36. Bottle 36 is inserted through hole 8 and into chamber 30 of plate 2 from the underside of plate 2 in a loose-fitting relationship. Referring to FIGS. 1 and 3A where the receptacle is in its first specified food holding orientation, collar 20 has a narrower cross section (i.e. narrower than cross section of first end 22 and hole 8) upward from base 6; this narrowing constitutes a constriction 37 in collar 20 (the constriction is shown in FIG. 1). This constriction prevents the beverage container (bottle 36 in the case of FIG. 3A) from being able to pass completely through collar 20 (when the beverage container is inserted into hole 8 from below base 6 in the arrangement of FIG. 3A) and allows plate 2 to rest on part of the outer surface of bottle 36. Other forms of restricting means for preventing the complete passage of a beverage container through hole 8 are also possible. For example, FIG. 4 shows a top view of a cylindrical collar 39 with fins 40 protruding from the inner surface of the collar and directed toward the axis of the cylindrical collar. FIG. 5 shows a side view of one such fin 40. Sections of a given fin extend an increasing distance from inner surface 26 toward the cylinder axis as a function of distance from base 6 of food holding plate 2 thereby creating a restricting means to obstruct the movement of a beverage container through cylindrical collar 39 after passing through hole 8. In some cases, perimeter 9 itself may serve as the restricting means, depending on the shape and size of the beverage container.

Inner surface 26 of collar 20 can have (but need not necessarily have) a contour that matches or complements the external surface of the portion of beverage container that is surrounded by the collar when the receptacle is mounted on the beverage container, but with a sufficient degree of tolerance between the internal surface 26 and the external surface of the beverage container so that the receptacle is loosely mountable on the beverage container. When the receptacle of the present invention is stably mounted on a beverage container it may be possible to wiggle the receptacle slightly by holding the receptacle at one point on its outer edge with the hand that is not holding the beverage container and vibrating that point slightly up and down.

Referring to FIG. 3A, by gripping bottle 36 by a first hand in a region proximal bottom portion 44 of the bottle, a user can support bottle 36 and plate 2 that is resting on bottle 36 by a single hand. This allows the diner to use his or her second hand for removing food items 34 from plate 2. When the diner wishes to drink some of the beverage in bottle 36 he/she simply grasps plate 2 by the second hand, separates plate 2 from bottle 36 that is held in the first hand, and drinks from bottle 36. This process is continued by replacing plate 2 on bottle 36 and repeating the steps. This invention allows one to dine comfortably in stand-up and similar situations and to avoid the awkwardness generally associated with simultaneously supporting and using a plate of food and a beverage container at cocktail parties, at other such stand-up functions, and at other dining venues where a table is not readily available. Separation of plate 2 from bottle 36 is accomplished simply by translating plate 2 upward and/or bottle 36 downward relative to the other component.

Mounting plate 2 on the beverage container and separating plate 2 from the beverage container are both facile operations because of the loose-fitting relationship between the two components. Because of the loose-fitting relationship between inner surface 26 of collar 20 and part of the outer surface of the beverage container minimal friction or other resistance is encountered in mounting the food holding receptacle on the beverage container. Pressing is not required in order to stably mount the plate on the beverage container and no special force (other than that due to gravity) need be applied in separating the receptacle from the beverage container. This feature facilitates the repetitive placement of plate 2 on, and removal of plate 2 from, the beverage container in a dining situation such as a cocktail party or when using the receptacle and beverage container while walking.

The beverage container serves as a handle for firmly and comfortably holding plate 2 when the plate is supported on a beverage container. Even though the plate is mounted on the beverage container in a loose-fitting relationship the plate is not easily dislodged from the beverage container if someone bumps into or jolts the person holding the beverage container with plate 2 supported thereon. Nevertheless, plate 2 can be instantly removed from the beverage container by simply lifting plate 2 upward using one hand while holding the lower portion of the beverage container by the other hand.

If one wishes to leave the plate on a table or other support, the plate in its first specified food holding orientation is stably supportable on a flat surface after demounting it from the beverage container. In some cases, the plate may also be left on a table while supported on a beverage container.

In using the food holding receptacle of the present invention in dining situations the beverage container typically would not be sealed with a cap or lid. However, it is possible to use the food holding receptacle in a dining situation in conjunction with a beverage container that is sealed with a lid having a hole therein through which to drink the beverage. When using the arrangement of the present invention for carrying food and beverage the beverage container may be used with or without a lid or cap.

Figure 3B:
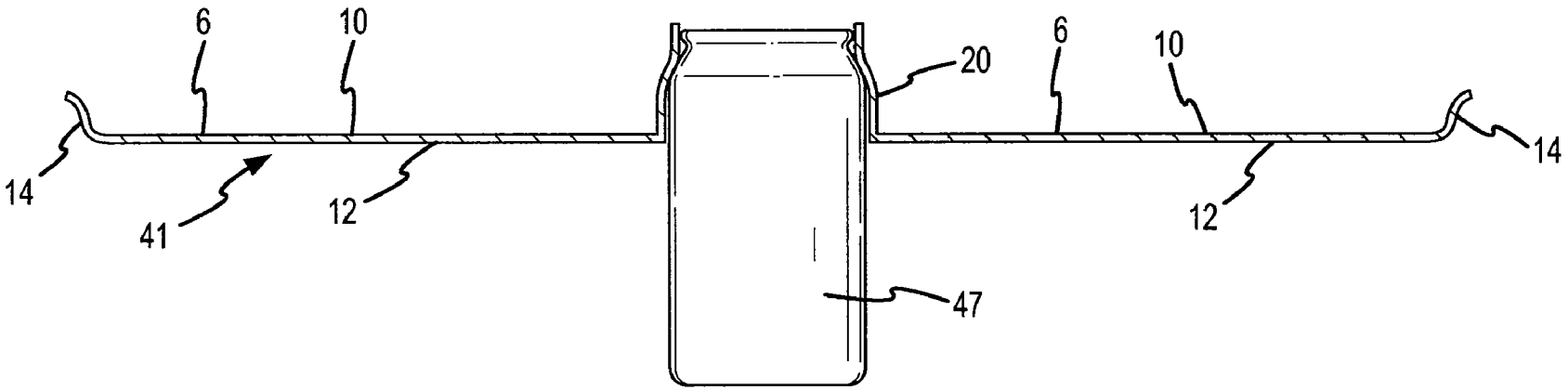
FIG. 3B shows a side view of an embodiment of the food holding receptacle of the present invention mounted on a beverage can (mode 1).
Figure 3C:
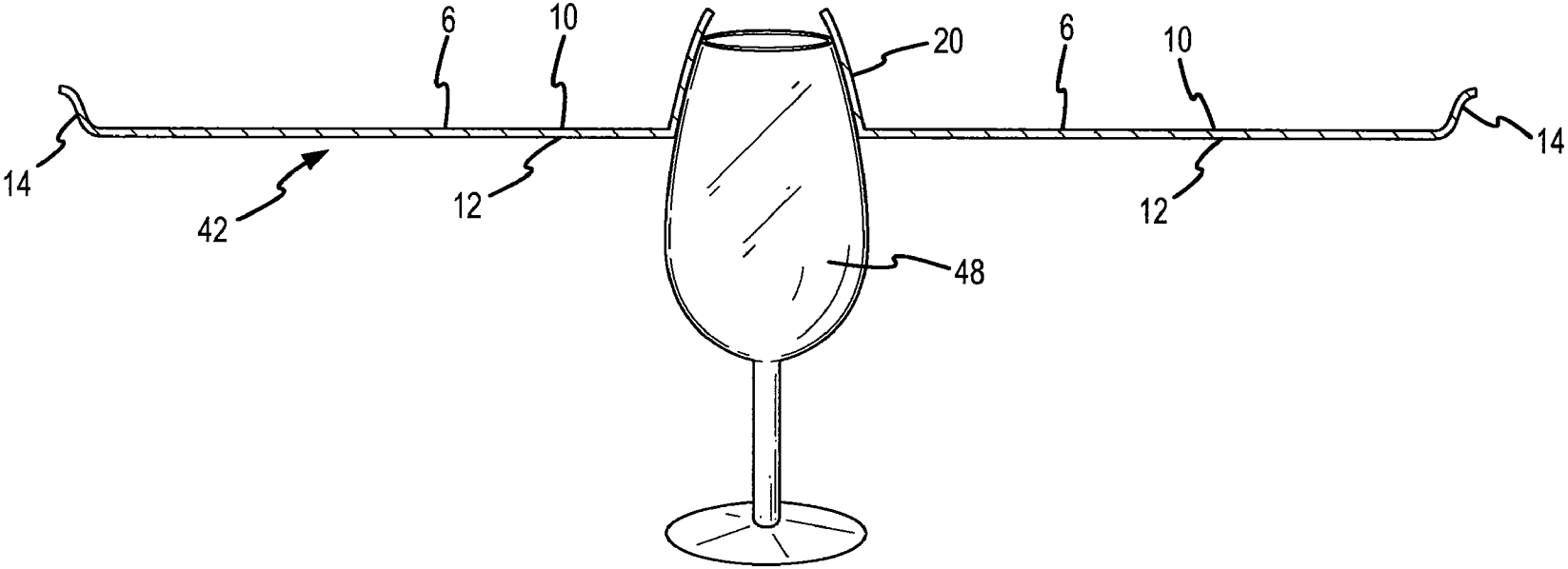
FIG. 3C shows an embodiment of the food holding receptacle of the present invention mounted on a stemware glass (mode 1).

The upper part of some beverage containers (particularly some bottles) may protrude from second end 24 of collar 20 when the receptacle is mounted on the beverage container, as shown in FIG. 3A. In other cases, the beverage container does not protrude through second end 24 of collar 20. FIG. 3B shows an embodiment 41 of the food holding receptacle of the present invention designed for stably mounting on a beverage can 47 in a loose-fitting relationship. FIG. 3C shows an embodiment 42 of the food holding receptacle of the present invention mounted on a stemware glass 48 such as a wine glass in a loose-fitting relationship. In FIGS. 3B and 3C, the food holding receptacle is stably mounted on the beverage container even though the receptacle is mounted in a loose fitting relationship.

The food holding receptacle of the present invention is freely mountable on the beverage container, meaning that:

(i) the arrangement is free of any form of active engagement (such as a press-fit, snap-on, screw-on, twist-on, tongue-in-groove or other such type of specific connection) between the receptacle and beverage container;

(ii) the receptacle is free of any appendage depending therefrom for gripping by the user in order to maintain the receptacle stably mounted on the beverage container; and, (iii) for mode 1 and mode 3, the user does not necessarily have to grip or touch the food holding receptacle in order to achieve the stable mounting.

When the food holding receptacle of the present invention is stably and loosely mounted on a beverage container the receptacle suspends from upper portion 38 of the beverage container where suspension region 55 of inner surface 26 of collar 20 is in contact with upper portion 38 of the beverage container (FIG. 3A). The center of gravity of the receptacle when mounted on the beverage container generally lies below the suspension region, and this contributes to the stable mounting of the receptacle on the beverage container.

Figure 6:
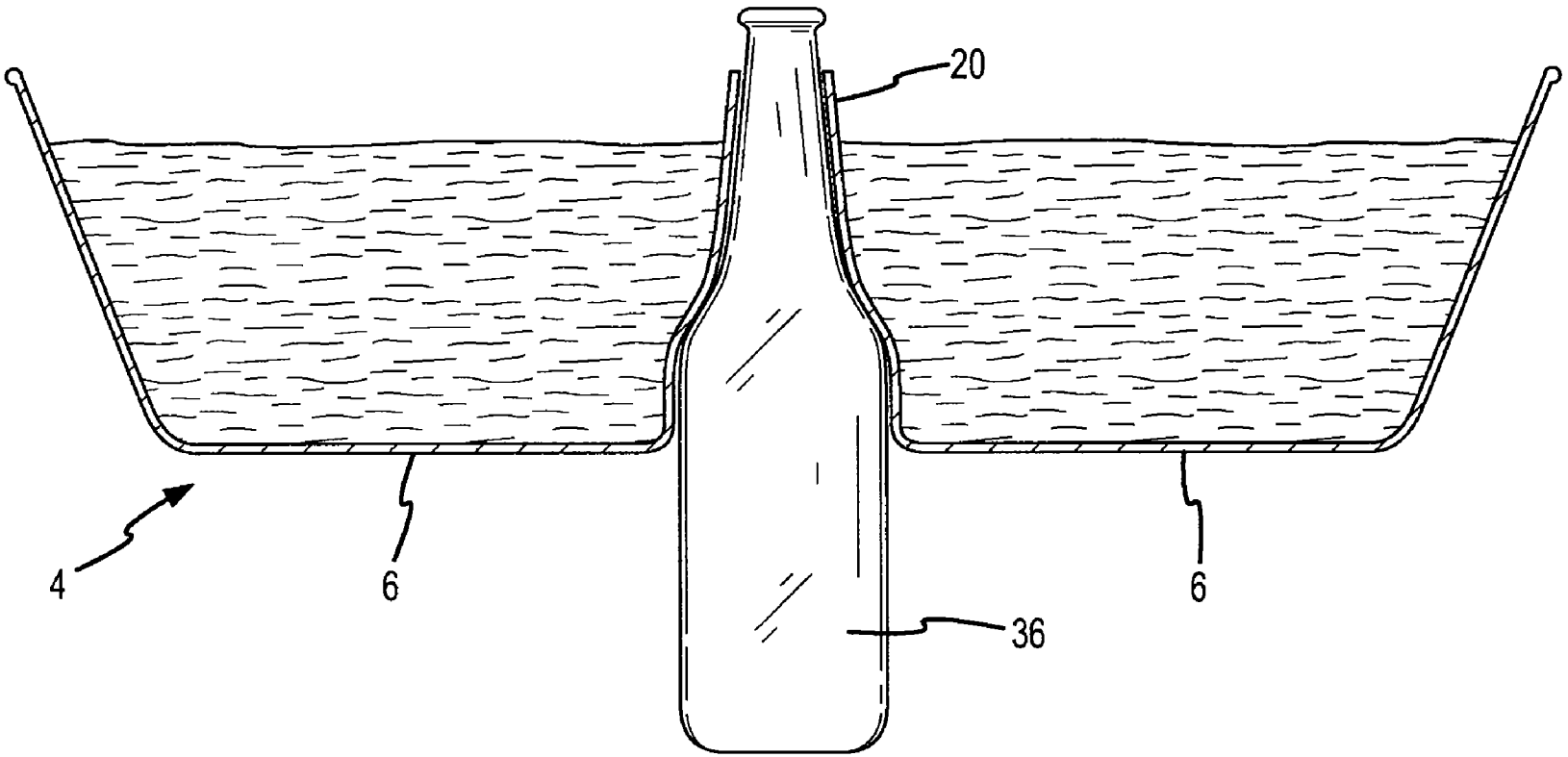
FIG. 6 shows a side view of an embodiment of the food holding receptacle of the present invention in the form of a bowl mounted on a bottle (mode 1)

The food holding receptacle of the present invention could be in the form of a bowl 4 or dish, as shown in FIG. 6, for holding soup, dessert, popcorn 65 or other food items where bowl 4 is supported on a beverage container. When the receptacle is in the form of a bowl as shown in FIG. 6 it generally resembles the shape of a Bundt pan or angel food pan.

Figure 7:
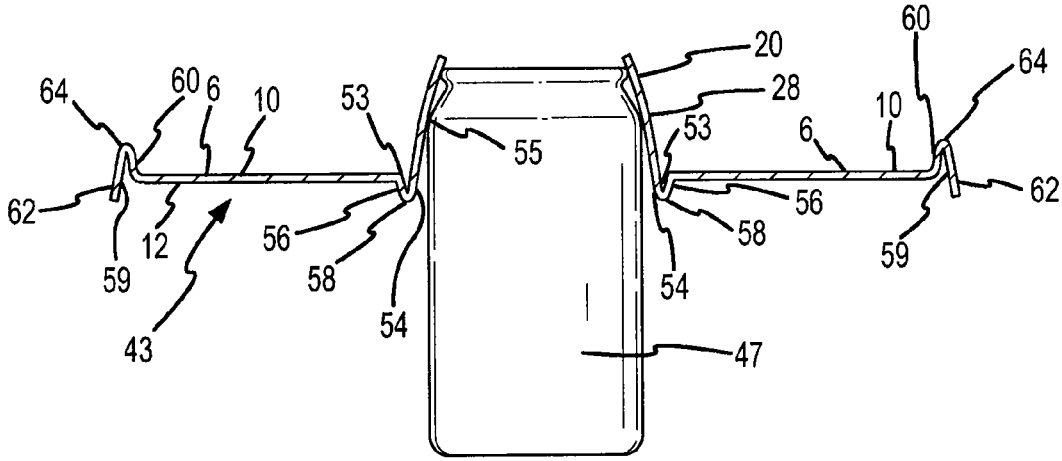
FIG. 7 shows a side view of another embodiment of the food holding receptacle of the present invention mounted on a beverage can according to mode 1 of the invention.
Figure 8:
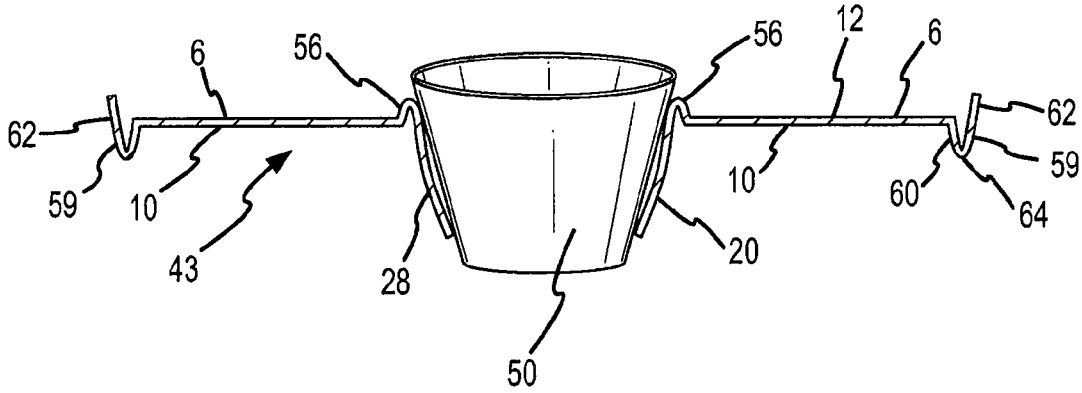
FIG. 8 shows a side view of the food holding receptacle from FIG. 7 with a frusto-conical bowl mounted thereon according to mode 2 of the invention.

The embodiments of the food holding receptacle shown in FIGS. 1, 3A, 3B and 3C are intended to have only a single food holding section, namely first surface 10, when the receptacle is in its first specified food holding orientation. FIG. 7 shows another embodiment 43 of the food holding receptacle of the present invention mounted on can 47. Plate 43 is illustrated in FIG. 7 in its first specified food holding orientation. This embodiment is also suitable for use in mode 2 where receptacle 43 is positioned in its second specified food holding orientation as shown in FIG. 8. The second specified food holding orientation of plate 43 as shown in FIG. 8 is obtained by rotating plate 43 essentially 180° about a horizontal axis relative to the first specified food holding orientation shown in FIG. 7. In FIG. 8 second surface 12 is facing upward and functions as a second food holding section. Embodiment 43 of the plate oriented as shown in FIG. 8 can stably hold and support various vessels including frusto-conical containers. FIG. 8 shows a frusto-conical bowl 50 supported within chamber 30 of collar 20. In this case the user grasps outer surface 28 of collar 20 by a single hand thereby supporting both plate 43 and frusto-conical bowl 50. In this mode of operation (mode 2) collar 20 acts as a handle for stably and comfortably supporting both plate 43 and bowl 50. Frusto-conical bowl 50 is not easily dislodged from plate 43 if someone bumps into or jolts the person holding the receptacle with a beverage container supported thereon. This is true also for other types of beverage containers when mounted on the food holding receptacle in mode 2. The beverage container can be instantly removed from the food holding receptacle by simply lifting the beverage container upward using one hand while holding the food holding receptacle by the other hand.

The embodiment of the food holding receptacle shown in FIGS. 7 and 8 has a barrier 53 projecting from second surface 12 and extending in the opposite direction to collar 20. Barrier 53 extends circumferentially around perimeter 9 of hole 8. Barrier 53 which extends upwardly in mode 2 prevents food from falling into hole 8 when the receptacle is in its second specified food holding orientation as shown in FIG. 8. Barrier 53, as shown in FIGS. 7 and 8, is composed of a first segment 54 and a second segment 56 joined at an apex 58 that, in cross section, resembles an inverted "V" 64. Furthermore, rim 59 in FIGS. 7 and 8 is designed so that it is can prevent food from falling off the outer edge of the plate regardless of whether plate 43 is positioned in its first specified food holding orientation (mode 1) or its second specified food holding orientation (mode 2). Rim 59 in FIGS. 7 and 8 is composed of a first segment 60 and a second segment 62 joined at apex 64.

Figure 9:
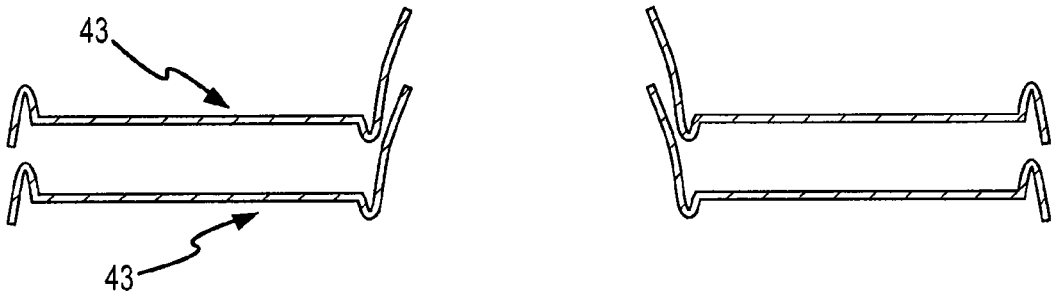
FIG. 9 shows a side view of two identical plates according to the present invention positioned to illustrate how receptacles of the present invention may be stackable.

Using methods well known in the prior art, the food holding receptacle of the present invention (e.g. FIG. 1 or FIG. 7) can be readily made in a stackable or nestable form such that a plurality of receptacles can be stacked together in a space-saving arrangement for storage or shipping. When stacked, the upper parts of a first receptacle fit into the corresponding parts on the underside of a second identical and similarly oriented receptacle that is placed on top of first receptacle. In designing the receptacles to be stackable, features that are well known in the prior art can be included for preventing the receptacles from nesting so closely that they stick together and are troublesome to separate. In the embodiment of the food holding receptacle shown in FIGS. 7 and 8 the design of barrier 53 and rim 59 allows the receptacles to be stackable. FIG. 9 shows a side view of two identical plates according to the present invention, one placed directly over the other, to illustrate how food holding receptacles of the present invention can be stackable. Embodiments of the food holding receptacle where the barrier and/or rim, or some other feature of the receptacle do not accommodate stackability are also possible.

According to mode 2 of using the food holding receptacle of the present invention, the user grasps collar 20 in a first hand with second surface 12 facing upward. A beverage container such as a cup is inserted into chamber 30 of collar 20. Items of food are placed on second surface 12 either before or after the beverage container is placed in chamber 30 of collar 20. In mode 2, second surface 12 functions as a second food holding section. The user can then use his or her second hand to take food items from second surface 12. When the user wishes to drink from the beverage container he or she uses the second hand to remove the beverage container from collar 20 and continues to grip the food holding receptacle by the first hand. Alternatively, a straw may be used to drink from the beverage container while it is supported on the food holding receptacle. Also, as illustrated in FIG. 8, a bowl 50 may be supported in collar 20. If, for example, bowl 50 contains soup, the user may drink such soup from the bowl as described above for a regular beverage. Or, the user may use a spoon to take soup from the bowl.

Figure 10A:
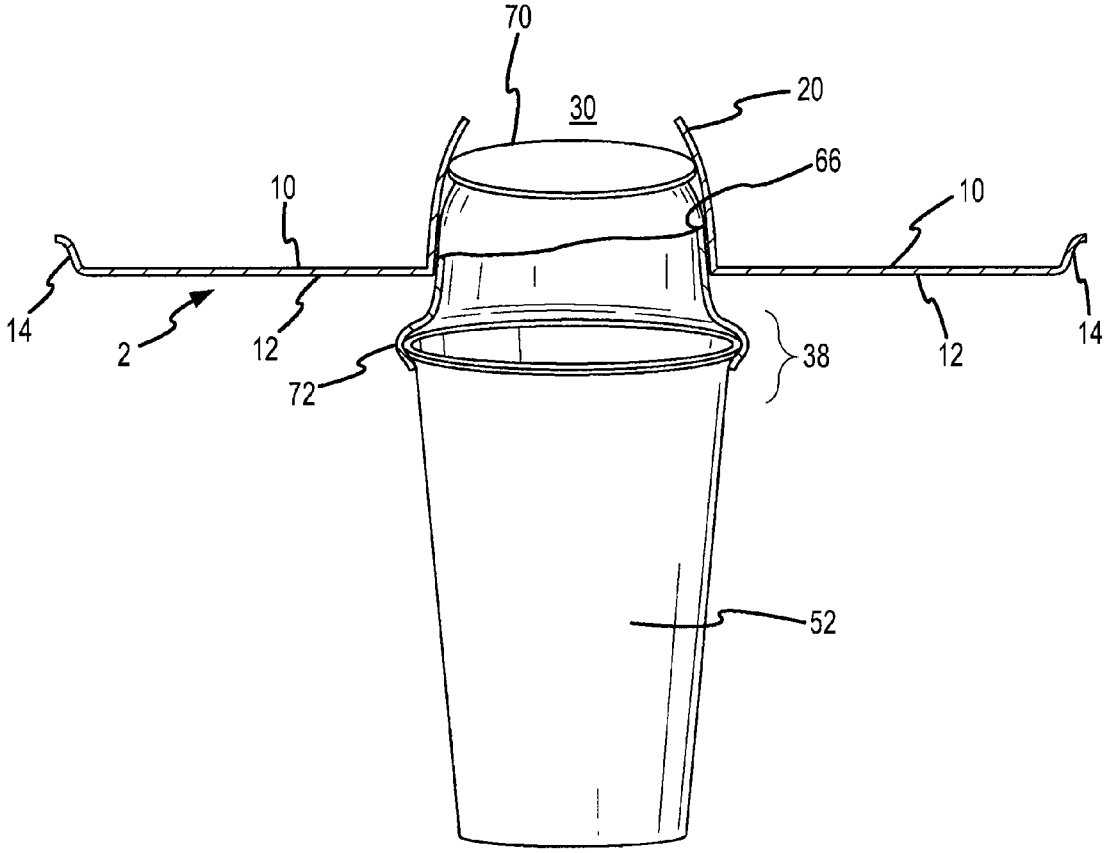
FIG. 10A shows a side view of the food holding receptacle of the present invention stably mounted on a connector unit that in turn is attached to a beverage container according to mode 3 of the invention.

The food holding receptacle of the present invention may also be mounted on a beverage container via a connector unit (mode 3). In mode 3 a connector unit 66 is used to join the food holding receptacle in its first specified food holding orientation to the beverage container as illustrated in FIG. 10A. In FIG. 10A lower section 72 of connector unit 66 connects to upper portion 38 of frusto-conical cup 52 by snapping, screwing or other means known in the prior art to produce a sealed or leak-proof joint. Upper section 70 of connector unit 66 is adapted to fit comfortably into chamber 30 of the food holding receptacle such that the food holding receptacle, in its first specified food holding orientation, is stably mountable on connector unit 66, and is thereby supported by the beverage container.

Figure 10B:
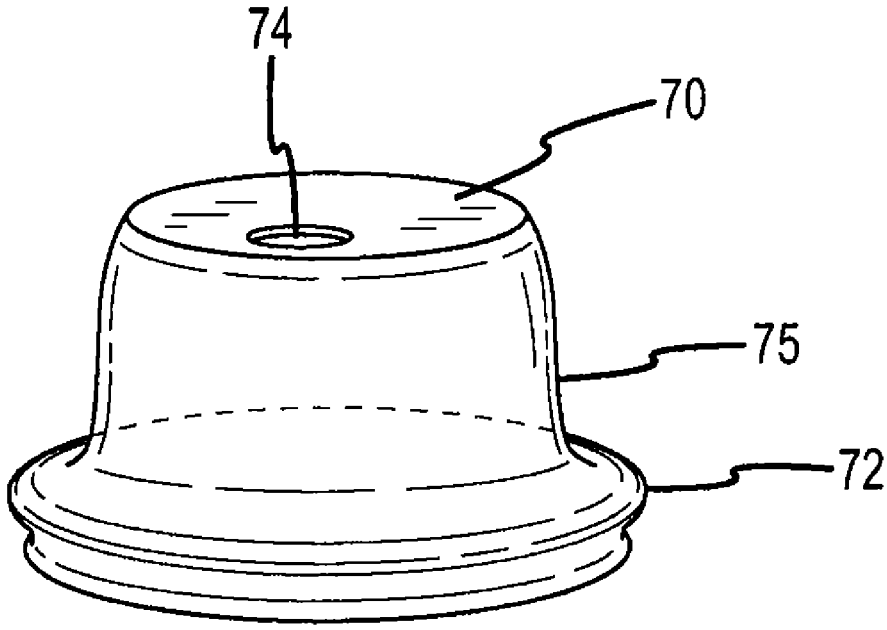
FIG. 10B shows another embodiment of the connector unit.

When the food holding receptacle is mounted on connector unit 66 that is joined to upper portion 38 of the beverage container (mode 3) the food holding receptacle is operated in essentially the same manner as for mode 1. The beverage container in its specified beverage holding orientation is held by a first hand; lower section 72 of connector unit 66 is attached to upper portion 38 of the beverage container; and the food holding receptacle in its first specified food holding orientation is mounted on connector unit 66. The user takes food items from the food holding receptacle with the second hand. When the user wishes to drink, he/she grips the food holding receptacle by the second hand and removes the beverage container with attached connector unit from under the food holding receptacle. The user drinks from the opening in upper section 70 of the connector unit, and then reinserts the connector unit (attached to beverage container) into chamber 30 of the food holding receptacle. Alternatively, upper section 70 of connector unit 75 may be partly closed but with an aperture 74, as shown in FIG. 10B, through which a beverage may be consumed. Some embodiments of the connector unit may be considered as specially designed lids for a beverage container, where the lid is characterized by its ability to be comfortably accommodated within the chamber of the food holding receptacle in some embodiments of the receptacle of the present invention. Connector unit 66 (FIG. 10A) or 75 (FIG. 10B) is constructed such that upper portion is accommodated by chamber 30 and the lower portion has a form and dimension to properly attach to a beverage container having an upper section of given form and dimensions to produce a sealed or leak-proof connection. Methods are well known in the prior art for forming a sealed connection between upper portion 38 of a beverage container and another unit, such as a lid where the sealed connection is leak-proof. This sealed connection prevents leakage of beverage when the user is drinking via the connector unit. A set of such connector units 66 with lower sections 72 of different forms and dimensions allows the food holding receptacle of the present invention to be stably mounted on, for example, frusto-conical cups of different dimensions. The connector unit can be designed to fit in a sealed, leak-proof manner on other types of beverage containers in addition to frusto-conical cups.

In an alternative embodiment of the connector unit, the receptacle is mountable on the upper section of the connector unit in a tight fitting relationship, and the lower section of the connector unit is mountable on the upper portion of a beverage container in loose-fitting relationship. In this case, the arrangement is used as follows. While the user holds the beverage container in one hand with the connector unit loosely mounted thereon, and with the receptacle tightly mounted on the connector unit, he/she uses the other hand to take food items from the receptacle. When the user wishes to drink from the beverage container, he/she removes the beverage container from underneath the connector unit and drinks from the beverage container in the normal manner. In this case the connector unit remains attached to the underside of the food holding receptacle while the user drinks from the beverage container. The connector unit, with the receptacle mounted thereon, is then re-mounted on the beverage container.

Figure 11:
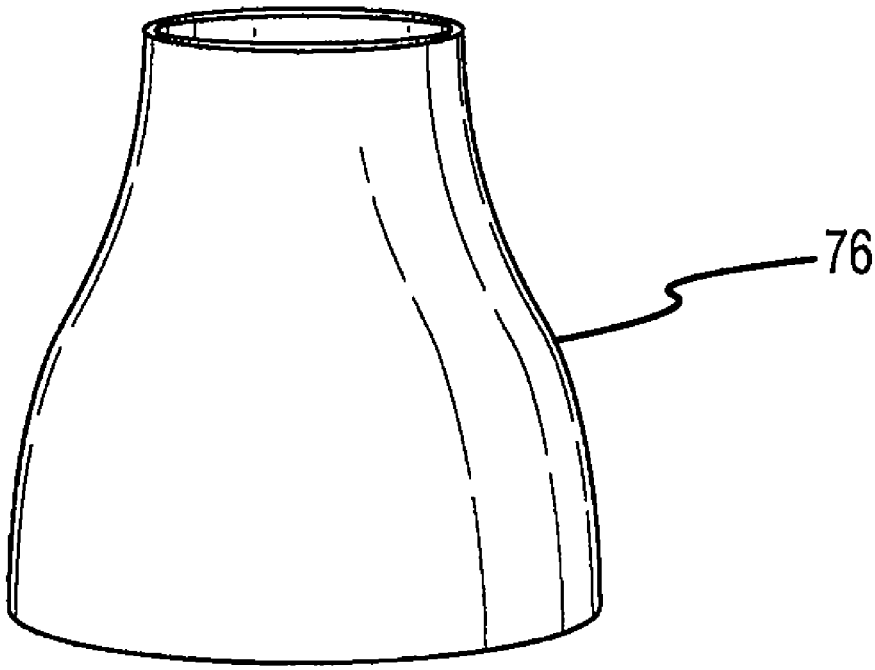
FIG. 11 shows a collar insert.

FIG. 11 shows a collar insert 76 for use with the food holding receptacle of the present invention. Such a collar insert 76 is preferably made from a soft-textured material and can be used in association with an embodiment of the food holding receptacle of the present invention particularly one that is made from hard material such as glass, ceramic, metal, or hard plastic. In this case collar insert 76 is inserted into chamber 30 of collar 20 of the food holding receptacle before the receptacle is mounted on a beverage container. Collar insert 76 can be removably attached to the inner surface of the collar of the food holding receptacle by any of a variety of methods that are known in the prior art. In this case, the external surface of collar insert 76 is designed to be generally complementary to inner surface 26 of collar 20 of the food holding receptacle, so that the collar insert and the collar nest or fit together comfortably. Such a collar insert cushions the contact between beverage containers and food holding receptacles, particularly those made from hard material.

Figure 12:
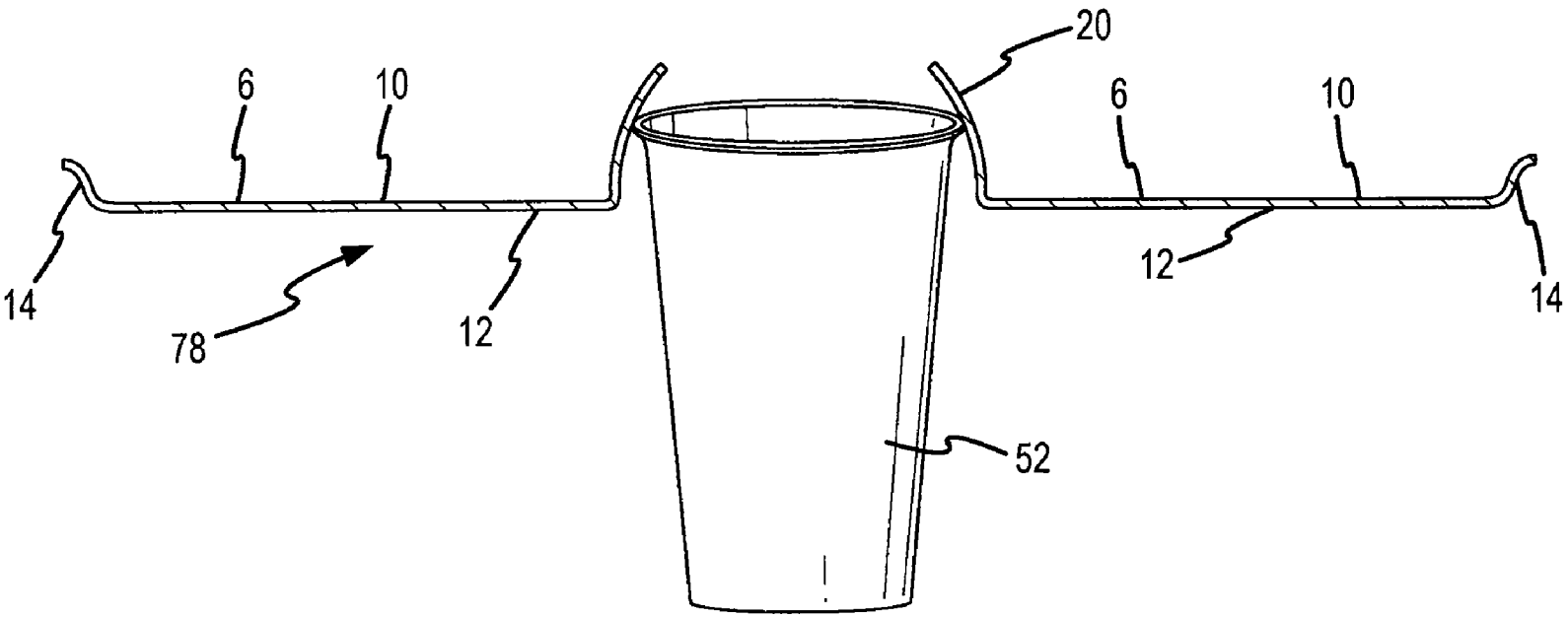
FIGS. 12 shows a side view of an embodiment of the food holding receptacle 78 mounted on a frusto-conical cup.
Figure 13A:
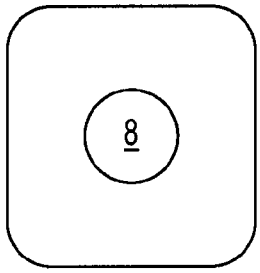
FIG. 13 shows bottom views illustrating several shapes (A-F) for the base of the food holding receptacle of the present invention.
Figure 13B:
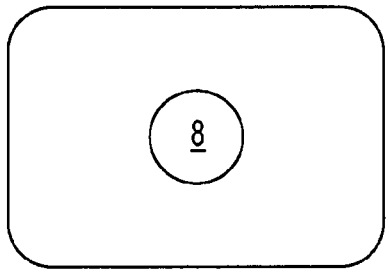
Figure 13C:
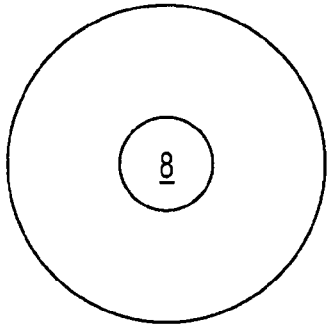
Figure 13D:
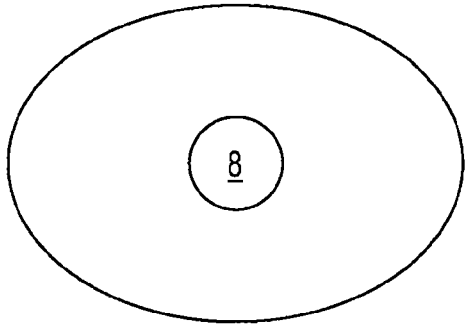
Figure 13E:
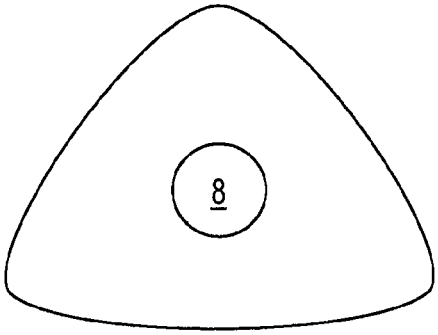
Figure 13F:
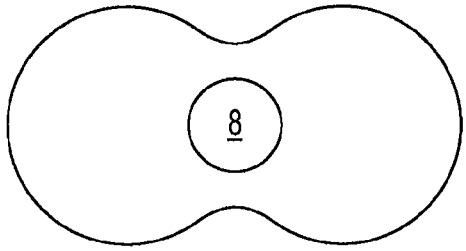

FIG. 12 shows an alternative embodiment of food holding receptacle 78 in its first specified food holding orientation mounted on frusto-conical cup 52.

FIG. 13 shows some of the many shapes that the base of the food holding receptacle of the present invention may adopt, each with a hole 8 therethrough: square (A); rectangular (B); circular (C); oval (D); triangular (E); and dumbbell shaped (F).

Outer surface 28 of collar 20 may be knurled, dimpled, corrugated, or made in other ways known in the prior art to facilitate comfortable and effective gripping of outer surface 28 when the receptacle is used in its second specified food holding orientation. When the food holding receptacle in its second specified food holding orientation is supporting a beverage container, the beverage container and the food holding receptacle can be separated from each other in a facile manner.

The food holding receptacle in its first specified food holding orientation is stably mountable on a beverage container (mode 1). This stability of mounting is remarkable considering that the food holding receptacle is mounted on the beverage container in a loose-fitting relationship. This stability can be demonstrated by tilting the beverage container from its specified beverage holding orientation while the food holding receptacle is mounted on the beverage container. Tilting the beverage container about a horizontal axis by as much as 70° to 80° from the specified beverage holding orientation will generally not cause the receptacle to fall off the beverage container. A beverage container is stably supportable on the food holding receptacle in its second specified food holding orientation (mode 2). Tilting the receptacle about a horizontal axis by as much as 70° to 80° from the second specified food holding orientation will generally not cause the beverage container to fall off the receptacle. Food holding receptacles of the present invention can be designed for use with differently shaped bottles, differently shaped cans, differently shaped non-stemware glasses, differently shaped stemware glasses, and differently shaped cups and mugs. In many cases, a food holding receptacle having a collar where all parts of the inner surface have a circular perimeter may be comfortably and stably mountable on a beverage container of noncircular cross section, for example, oval, square or polygonal.

The loose-fitting relationship between the food holding receptacle of the present invention and the beverage container upon which the receptacle is mounted allows the receptacle to be readily rotated relative to the beverage container. This is advantageous when dining as it allows a diner to rotate the plate to access food items on all parts of the food holding receptacle without having to release his or her grip on the beverage container. This is a simpler operation than rotating the beverage container.

It is evident that a food holding section of the present invention could be compartmentalized, having separate compartments for holding different food items, regardless of whether the food holding receptacle is in the form of a plate, a bowl, or some other form. Reinforcements may be added to the receptacle, particularly to the base, to provide additional rigidity; methods are known in the prior art for incorporating such reinforcements. It should be further recognized that the present invention is of value not only at the moment a person is dining but also for comfortably carrying food and beverage from the point of purchase to the dining location. In mode 1, the food holding receptacle is stably mounted on the beverage container in a manner that the food holding receptacle is not readily dislodged from the beverage container when a person is making his or her way though a throng of people or going through a food line. Similarly in mode 2, the beverage container is stably supported on the food holding receptacle in a manner that the beverage container is not readily dislodged from the food holding receptacle when a person is making his or her way though a throng of people or going through a food line.

Cross sections of collar 20 parallel to base 6 and at different distances from base 6 may be circular as illustrated in FIGS. 1 and 2. These cross sections may also take other forms such as triangular, square, pentagonal, hexagonal, and in general polygonal forms. Thus, the inner surface of the collar may be truncated pyramidal in shape (pyramidal frustum), at least in part. Inner surface 26 of collar 20 may be generally smooth. Alternatively, inner surface 26 may be dimpled, corrugated, ribbed (circumferential or up-down), stepped, or have some other form of unevenness.

For collars made from materials such as plastic or paper the inner surface may be somewhat resilient and have a soft texture or feel. The resiliency may be inherent to the material itself. Alternatively, the resiliency can be produced by any of a variety of methods known in the prior art, such as by having hairs, bristles, ribs, or other flexible protrusions extending from the inner surface. When the resiliency is due to bristles, the bristles may be located over all of inner surface 26 of collar 20 or only in select regions such as in a circular strip at first end 22 of collar 20 close to base 6. Alternatively, velveteen or suede type material may be used as part of inner surface 26 of collar 20. A soft texture on inner surface 26 of collar 20 leads to a softer contact between the contact region of inner surface 26 of collar 20 and the contact region of outer surface of the beverage container upon which collar 20 is resting. Furthermore, such a soft textured or resilient inner surface 26 as discussed above serves as a contour-adjusting means allowing part of collar 20 to adapt, to some degree, to the external contours of a beverage container while still engaging the beverage container in a loose-fitting relationship.

When holding hot liquids in disposable frusto-conical cups that do not have handles it is common to use a cup holder or sleeve protector around the cup to insulate the user's hand from the heat of the cup. The need for such an accessory is diminished when supporting the frusto-conical cup on the food holding receptacle of the present invention (mode 2). In mode 2 the beverage container is held within chamber 30 of collar 20 and the user grips outer surface 28 of collar 20. Thus, collar 20 serves as a cup holder or sleeve protector to insulate the user's hand from the heat of the cup, and it is not a problem to hold the hot cup for the relatively brief period required to drink some beverage before returning the cup to the chamber. If cup holders are to be used in conjunction with the food holding receptacle in mode 2, they can be accommodated within chamber 30 by making the diameter of hole 8 and lower end 22 of collar 20 sufficiently large.

It is clear that the food holding receptacle of the present invention could also be of value when the user is seated but without the benefit of a table on which to place a plate or a beverage container, or when the user is sitting up in bed. The term stand-up situation refers to the various dining or food carrying situations where a person must support both a food holding receptacle and a beverage container simultaneously.

The food holding receptacle of the present invention could be manufactured in any of several ways, for example by various forms of molding, thermoforming, or by machining. The food holding receptacle could be made from any of a variety of materials such as plastic (foamed or unfoamed), paper, glass, wood, metal, ceramic or china. The food holding receptacle may be made of reusable ware or may be disposable. The receptacle could be manufactured in a single piece. Alternatively, the receptacle could be produced in parts which are then assembled into the complete food holding receptacle. It is also clear that the collar of the present invention could contain holes so long as the holes do not allow food items to fall off the food holding receptacle. The collar could consist of a band attached to perimeter 9 (and extending upwardly from first surface 10 when receptacle is in its first specified food holding orientation) with fingers extending upwardly from the band to form a restricting means.

The appearance of the food holding receptacle of the present invention can be enhanced by adding designs to the outer surface of the collar. Such designs could also be used for promotional purposes.

Presently preferred embodiments of the invention have been described above. These embodiments are intended to be illustrative of the invention and not limiting. The scope of the invention is defined by the appended claims. Other modifications of the invention will become obvious to those skilled in the art upon reading this disclosure and will be within the scope of the present invention.

I claim:

1. A food holding receptacle for use in combination with a beverage container, said food holding receptacle stably mountable on the beverage container in loose-fitting relationship, said receptacle comprising:

a base having a hole of a first perimeter;

said hole partially, but not completely, penetrable by the beverage container;

said base having a first surface facing upward and comprising a first food holding section surrounding said hole;

a collar extending upwardly from said base having a first opened lower end having a lower perimeter and a second opened upper end having an upper perimeter, said upper end and said lower end defining an inner surface, said collar joined to said base in substantially fixed relationship such that said lower perimeter is substantially coincident with said first perimeter, said collar being devoid of a compartment for receiving food items;

wherein said collar is adapted to surround an upper portion of an outer surface of the beverage container wherein a portion of the beverage container penetrates said hole to provide the loose-fitting relationship between said receptacle and the beverage container when said receptacle is mounted on the beverage container, wherein a tolerance is provided between portions of the outer surface of the beverage container and said inner surface when said receptacle is mounted on the beverage container, said tolerance contributing to the loose-fitting relationship that allows said receptacle to be wiggled while sitting stably on the beverage container.

2. The receptacle as described in claim 1 wherein:

the upper portion of the outer surface of the beverage container has specified external dimensions; and said collar configured to fit over and rest upon the upper portion of the beverage container.

3. The receptacle as described in claim 1 wherein said inner surface is non-cylindrical.

4. The receptacle as described in claim 1 wherein:

said receptacle comprises one of a plurality of substantially identical receptacles, the top section of a first one of said receptacles being disposed to nest with the bottom section of a second one of said receptacles in a generally complementary relationship, both said receptacles oriented in the same direction.

5. The receptacle as described in claim 1 wherein said receptacle is a plate, a bowl, a dish, or a tray.

6. The receptacle as described in claim 1 wherein:

said base has an outer edge; and, a rim attached to said base at said outer edge.

7. The receptacle as described in claim 1 wherein said loose-fitting relationship between said receptacle and the beverage container allows said receptacle to be readily rotated in a spinning manner relative to the beverage container about a vertical axis while said receptacle is stably mounted on the beverage container.

8. The receptacle as described in claim 1 wherein said receptacle is freely mountable on the beverage container.

9. The receptacle as described in claim 6 wherein said receptacle has a first food holding orientation and a second food holding orientation that is obtainable by rotating said receptacle essentially 180° about a horizontal axis with respect to said first food holding orientation;

said base having a second surface surrounding said hole;

said second surface facing upward and serving as a second food holding section when said receptacle is in said second food holding orientation;

a circumferential barrier adjacent to and surrounding said hole; said barrier extending upwardly from said base when said receptacle is in said second food holding orientation;

said rim comprising a first rim segment and a second rim segment;

said first rim segment joined to and extending above said base when said receptacle is in said first food holding orientation;

said second rim segment joined to and extending above said base when said receptacle is in said second food holding orientation, and wherein said food holding receptacle in said second food holding orientation can stably support the beverage container when placed in said collar.

10. The receptacle as described in claim 9 wherein said receptacle comprises a first receptacle of a set of substantially identical receptacles, the underside of said first receptacle complementary to the upper side of a second receptacle from said set of receptacles and disposed to nest with said upper side of said second receptacle, both said receptacles oriented in the same direction.

11. A food holding receptacle adapted for selectively mounting on a beverage container in a stable yet loose fitting manner, comprising:

a base having an upward facing surface;

said upward facing surface comprising a food holding section, said base having a hole of a first perimeter passing therethrough;

a collar, devoid of a food holding compartment, joined to said base and extending upwardly therefrom, said collar defined by a first opened lower end and a second opened upper end, said lower end being larger than said upper end, said collar also having a generally smooth inner surface that extends from said upper end to said lower end, said inner surface also having a vertical cross sectional profile that has at least one arcuate portion, which is positioned between said upper end and said lower end, and a suspension region, which is positioned between said upper end and said lower end, said suspension region possessing a surface area that is less than the surface area of said inner surface, said collar adapted to surround an upper portion of an outer surface of the beverage container wherein only said suspension region rests on the beverage container to provide a loose-fitting relationship between said receptacle and the beverage container when said receptacle is mounted on the beverage container, said beverage container penetrating said hole only in part.

12. The food holding receptacle as described in claim 11 characterized in that said receptacle can be repeatedly stably mounted on and demounted from the beverage container in a facile manner in a dining situation, wherein essentially no force other than that due to gravity acts on said receptacle during the mounting, essentially no force other than that required to overcome the force of gravity on said receptacle is applied to said receptacle during the demounting, and no active engagement occurs between the receptacle and the beverage container during said mounting.

13. The food holding receptacle as described in claim 11 wherein said receptacle is stably mountable on said beverage container regardless of whether or not the beverage container has a protruding lip, tab, or threading at its upper end.

14. A food holding receptacle adapted to be mountable on a beverage container, the receptacle comprising:

a base with a hole therethrough;

an open tubular collar joined at a first end to said base and surrounding said hole, said collar extending upwardly from said base, said collar having an inner surface with a suspension region from which said receptacle is suspendible, said suspension region possesses a surface area less than the surface area of said inner surface, wherein said suspension region is comprised of one or more projections from said inner surface with innermost sections that gradually approach an imaginary central axis that is orthogonal to said base as a function of upward distance from the center of said hole, wherein different sets of horizontally disposed segments of said projections, which are defined by the intersection of multiple imaginary horizontal planes with said inner surface, limit the extent to which different beverage containers can penetrate said hole when said receptacle is mounted on the beverage container.

15. The food holding receptacle as described in claim 14 wherein said one or more projections are elongated and arranged in a generally up-down direction along said inner surface.

16. The food holding receptacle as described in claim 14 wherein said one or more projections are elongated and arranged in a generally horizontal direction along said inner surface.

17. The food holding receptacle as described in claim 14 wherein the shortest horizontal distance from a point along a central axis of said collar to any of said one or more projections decreases as the vertical distance of the point on said central axis from the plane of said hole increases.

18. The food holding receptacle as described in claim 11, wherein the center of gravity of the receptacle when mounted on the beverage container generally lies below said suspension region.

19. The receptacle as described in claim 1, wherein said inner surface has a vertical cross sectional profile that is a combination of linear and non-linear segments.

20. The receptacle as described in claim 1, wherein said inner surface has a cross sectional profile that is arcuate.

21. The receptacle as described in claim 1, wherein said inner surface has a cross sectional profile that comprises a combination of interconnected arcuate segments.

22. A food-holding receptacle adapted for mounting on a beverage container comprising:

a base having a hole of a specified perimeter, said base having a first surface facing upward and comprising a first food holding section surrounding said hole;

a collar connected to said base and extending upwardly from said perimeter;

said collar having an inner surface and only partly penetrable by the beverage container when the beverage container is in an upright orientation and is inserted into said hole from underneath said receptacle;

said collar contoured to provide a suspension region that is disposed around said inner surface, said suspension region having a surface area that is less than that of said inner surface; and said collar having a first opened lower end having a lower perimeter and a second opened upper end having an upper perimeter, said upper end and said lower end defining said inner surface, said collar joined to said base in substantially fixed relationship such that said lower perimeter is substantially coincident with said perimeter of said hole, and said collar being devoid of a food holding compartment;

whereby said receptacle is predisposed to suspend loosely and stably from a portion of an outer surface of the beverage container when said receptacle is mounted on the beverage container.

23. The food-holding receptacle as described in claim 22 wherein said collar is contoured to provide multiple independent suspension regions on said inner surface;

each of said suspension regions horizontally disposed around said inner surface when said receptacle is in a first food-holding orientation, said suspension regions each having a surface area that is less than that of said inner surface;

wherein said suspension regions are spaced at predetermined vertical levels within said collar;

wherein said suspension regions are configured to allow one of said suspension regions to rest stably and loosely on a portion of the outer surface of the beverage container when said receptacle is mounted on the beverage container; and whereby said receptacle is predisposed to suspend loosely and stably at one of said suspension regions from a portion of the outer surface of the beverage container.

24. The food-holding receptacle as described in claim 22 wherein when said receptacle is stably mounted on the beverage container a gap occurs between part of said inner surface and a horizontally adjacent part of the outer surface of the beverage container below the level of said suspension region.

25. The food-holding receptacle as described in claim 22 wherein when said receptacle is stably mounted on the beverage container a gap occurs between part of said inner surface and a horizontally adjacent part of the outer surface of the beverage container above the level of said suspension region.

26. A food-holding receptacle for mounting on a beverage container when said receptacle is in a first food-holding orientation and the beverage container is in its upright, beverage-holding orientation, the receptacle comprising:

a base having a hole of a specified perimeter, said base also having a first surface facing upward and comprising a first food holding section surrounding said hole when said receptacle is in said first food-holding orientation;

a collar connected to said base and extending upwardly from said perimeter when said receptacle is in said first food-holding orientation, said collar only partly penetrable by the beverage container when the beverage container in said upright orientation is inserted into said hole from underneath said receptacle when said receptacle is in said first food-holding orientation said collar defined by a first opened lower end having a lower perimeter and a second opened upper end having an upper perimeter, said upper end and said lower end defining an inner surface, said collar joined to said base in substantially fixed relationship such that said lower perimeter is substantially coincident with said perimeter of said hole, said collar being devoid of a food holding compartment; and whereby said receptacle is predisposed to suspend loosely and stably from a portion of the outer surface of said beverage container.

27. The food-holding receptacle as described in claim 26 wherein said receptacle provides multiple independent suspension regions interior of said collar;

wherein said suspension regions are spaced at predetermined vertical levels within said collar when said receptacle is in said first food-holding orientation;

wherein said suspension regions are configured to allow one of said suspension regions to rest stably and loosely on a portion of the outer surface of said beverage container when said receptacle is mounted on the beverage container; and whereby said receptacle is predisposed to suspend loosely and stably at one of said suspension regions from a portion of the outer surface of the beverage container.

28. A food-holding receptacle adapted for mounting on a beverage container, comprising:

a base having a hole of a specified perimeter, said base having a first surface facing upward and comprising a first food holding section surrounding said hole;

a collar connected to said base extending upwardly from said perimeter, said collar having an inner surface;

wherein said collar is only partly penetrable by the beverage container when the beverage container is inserted into said hole from underneath said receptacle;

wherein said collar symmetrically surrounding an imaginary axis extending through center of said hole and orthogonal to said first surface;

wherein an imaginary plane containing said imaginary axis vertically intersects said collar to produce two intersection curves on opposite sides of said collar;

said collar configured such that each of said intersection curves extends monotonically downward as a function of increasing horizontal distance from said imaginary axis, beginning at an upper part of said collar and continuing downward for a first predetermined distance at a first average slope, then continuing downward at a second average slope for a second predetermined distance, and then continuing downward at a third average slope for a third predetermined distance until said intersection curves reach said perimeter; each of said first slope and said third slope greater than said second slope;

said collar configured to rest stably and loosely on a portion of the outer surface of said beverage container when said receptacle is mounted on the beverage container.

29. The food-holding receptacle as described in claim 28 wherein said collar is contoured to provide multiple suspension regions on said inner surface;

each of said suspension regions horizontally disposed around said inner surface and defined by a discrete portion of said curves;

wherein said suspension regions are spaced at predetermined vertical levels within said collar;

wherein said suspension regions are configured to allow one of said suspension regions to rest stably and loosely on a portion of the outer surface of the beverage container when said receptacle is mounted on the beverage container; and whereby said receptacle is predisposed to suspend loosely and stably at one of said suspension regions from a portion of the outer surface of the beverage container.

30. A food-holding receptacle adapted for mounting on a beverage container, comprising:

a base having a hole of a specified perimeter, said base having a first surface facing upward and comprising a first food-holding section surrounding said hole;

a collar connected to said base and having an inner surface with a generally upright bottle-shaped contour having a neck section connected at its lower end to a shoulder section that, in turn, is connected to a body section that is attached at its lower end to said base at said perimeter, wherein the average slope of the inner surface of said collar at said neck section and the average slope of the inner surface of said collar at said body section are each greater than the average slope of the inner surface of said collar at said shoulder section;

wherein said bottle-shaped contour configured to provide a suspension region on said inner surface that is adapted to rest loosely and stably on a portion of the outer surface of the beverage container;

wherein said suspension region is horizontally disposed around said inner surface.

31. The food-holding receptacle as described in claim 30 wherein said bottle-shaped contour is configured to provide multiple suspension regions on said inner surface;

wherein each of said suspension regions horizontally disposed around said inner surface;

wherein said suspension regions spaced at predetermined vertical levels within said collar;

wherein said suspension regions configured to allow one of said regions to rest stably and loosely on a portion of the outer surface of the beverage container when said receptacle is mounted on the beverage container; and whereby said receptacle is predisposed to suspend loosely and stably at one of said suspension regions from a portion of the outer surface of the beverage container.

32. The food holding receptacle as described in claim 26 wherein said base also has a second surface that faces upward and comprises a second food holding section surrounding said hole when said receptacle is rotated essentially 180° about an horizontal axis and relative to said first food-holding orientation, said base also having a first rim projecting upwardly from said base when said second surface is facing upward, said first rim being adjacent to and surrounding said hole, and a second rim located adjacent to an outer edge of said base, said second rim configured to prevent food items from falling off said receptacle when said first surface is facing upward and alternatively when said second surface is facing upward.

* * * * *

UNITED STATES PATENT AND TRADEMARK OFFICE

CERTIFICATE OF CORRECTION

PATENT NO. : 8,186,538 B2
APPLICATION NO. : 11/279366
DATED : May 29, 2012
INVENTOR(S) : Patrick MacCarthy It is certified that error appears in the above-identified patent and that said Letters Patent is hereby corrected as shown below:

In Claim 14, column 24, lines 43-44, delete "inner surface" and replace with --innermost sections--.

In Claim 26, column 26, line 5, delete "upright orientation" and replace with --upright, beverage-holding orientation--.

In Claim 26, column 26, line 18, delete "the outer surface" and replace with --an outer surface--.

In Claim 28, column 26, line 63, delete "the outer surface" and replace with --an outer surface--.

In Claim 30, column 27, line 31, delete "the outer surface" and replace with --an outer surface--.

Signed and Sealed this
Twenty-third Day of October, 2012

David J. Kappos

David J. Kappos
*Director of the United States Patent and Trademark Office*